US005922519A

United States Patent [19]

Ishikawa et al.

[11] Patent Number: 5,922,519

[45] Date of Patent: Jul. 13, 1999

[54] METHOD FOR PROCESSING SILVER HALIDE COLOR PHOTOGRAPHIC PHOTOSENSITIVE MATERIAL

[75] Inventors: Takatoshi Ishikawa; Masaru Yoshikawa; Tetsuro Kojima, all of Minami-ashigara, Japan

[73] Assignee: Fuji Photo Film Co., Ltd., Minami-ashigara, Japan

[21] Appl. No.: 08/653,013

[22] Filed: May 24, 1996

[30] Foreign Application Priority Data

May 31, 1995 [JP] Japan ..... 7-155561

[51] Int. Cl.[6] ..... G03C 7/42

[52] U.S. Cl. ..... 430/393; 430/455; 430/460

[58] Field of Search ..... 430/393, 455, 430/460, 487, 496

[56] References Cited

U.S. PATENT DOCUMENTS

| | | | |
|---|---|---|---|
| H1593 | 9/1996 | Haraga et al. | 430/496 |
| 5,002,859 | 3/1991 | Kuse et al. | 430/393 |

*Primary Examiner*—Hoa Van Le

*Attorney, Agent, or Firm*—Burns, Doane, Swecker & Mathis, LLP

[57] ABSTRACT

A method for processing a silver halide color photographic photosensitive material comprises the steps of desilverizing a photosensitive silver halide material having at least one red-sensitive layer, green-sensitive layer and blue-sensitive layer respectively on one side of a transparent support and a magnetic recording layer containing magnetic grains on the other side after the color development and then washing it with water and/or stabilizing it, wherein a bath having fixing function used in the desilverization step contains the following compound or analogue thereof.

$$H_2N\overset{\overset{\displaystyle S}{\|}}{C}NHCH_2CH_2SO_3NH_4$$

This method does not impair the S/N ratio of the magnetically recorded information and excellent desilverization effect can be obtained.

20 Claims, No Drawings

METHOD FOR PROCESSING SILVER HALIDE COLOR PHOTOGRAPHIC PHOTOSENSITIVE MATERIAL

BACKGROUND OF THE INVENTION

The present invention relates to a method for processing a silver halide color phoptographic photosensitive material, which has a magnetic recording layer. In particular, the present invention provides a processing method having excellent properties of reading a magnetic information.

Hitherto, it has been substantially impossible to input or output information at the time of taking a picture or printing when a silver halide photographic photosensitive material (hereinafter referred to as "the photosensitive material") is used, and only optical input and output of the date of taking the photograph have been possible in the prior art. On the other hand, as disclosed in Japanese Patent unexamined Published Application (hereinafter referred to as "J. P. KOKAI") Nos. Hei 4-68336, 4-73737 and 5-88283, it is made possible to input the condition of taking the photograph (e.g., date, weather, photographic conditions such as reduction/enlargement ratio), number of sheets of reprints, a portion to be zoomed, messages, developing and printing conditions and the like in the photosensitive material. Further, in the input in image-projection devices such as televisions/videos, it becomes possible to provide various informations, and therefore, such a method would be hopeful for the future.

In processing such a photosensitive material, the material is usually processed in the steps of color development, desilverization, washing with water and stabilization. The desilverization methods can be roughly divided into two methods, i.e. a method wherein the bleaching and fixing are conducted separately from each other and a method wherein a bleach-fixing solution having the two functions is used. Particularly, photosensitive materials for photography have a silver content higher than that of printing materials, and silver bromoiodide is mainly used in the former. As a result, the load of desilverization is heavy, particularly, the load in the fixing step is heavy to necessitate a long time for the processing in the former. Particularly in the continuous process such as running process, iodine ion dissolved out of the photosensitive material is accumulated to cause problems that the fixing function is inhibited and that the accuracy is reduced in reading the magnetic recording. It has been found that such problems are more serious in the bleach-fixing step wherein both bleaching and fixing are conducted at the same time than in the bleach-fixing step.

After analyzing the causes of the deterioration of the magnetic recording properties, the inventors have found that silver sulfide remaining in a very small amount in the photosensitive material exerts a bad influence. The inventors have also found that the bad influence becomes serious as the concentration of iodine ion is increased and that such an influence becomes more serious in the bleach-fixing solution.

SUMMARY OF THE INVENTION

Therefore, a primary the object of the present invention is to provide a method for processing a silver halide color photographic photosensitive material wherein the photosensitive material having a transparent magnetic recording layer is processed without deteriorating the S/N ratio of the magnetically recorded information.

Another object of the invention is to provide a fixing process having a high desilverizing capacity.

These and other objects of the invention will be apparent from the following description and Examples.

The inventors have found that the above-described problems can be solved by the following processing methods:

(1) A method for processing a silver halide color photographic photosensitive material which comprises the steps of desilverizing a silver halide photosensitive material having at least one red-sensitive layer, green-sensitive layer and blue-sensitive layer respectively on one side of a transparent support and a magnetic recording layer containing magnetic grains on the other side after the color development and then washing it with water and/or stabilizing it, wherein a bath having fixing function used in the desilverization step contains a compound of the following formula (I):

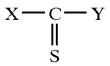

wherein X and Y each represent an alkyl group, alkenyl group, aralkyl group, aryl group, heterocyclic group, $—N(R^1)R^2$, $—N(R^3)N(R^4)R^5$, $—OR^6$ or $—SR^7$, or X and Y may together form a ring, with the proviso that at least one of X and Y is substituted with at least one of carboxylic acids or salts thereof, sulfonic acids or salts thereof, phosphonic acids or salts thereof, amino groups, ammonium groups and hydroxyl group, $R^1$, $R^2$, $R^3$, $R^4$ and $R^5$ each represent a hydrogen atom, alkyl group, alkenyl group, aralkyl group, aryl group or heterocyclic group, and $R^6$ and $R^7$ each represent a hydrogen atom, cation, alkyl group, alkenyl group, aralkyl group, aryl group or heterocyclic group.

(2) The method according to above item (1), wherein the bath having the fixing faculty contains 00.003 to 0.03 mol/l of iodine ion.

(3) The method according to above item (1), wherein the bath having the fixing faculty contains thiosulfuric acid group and the compound of the above formula (I) in a molar ratio of 1:0.5 to 1:0.30.

(4) The method according to above item (1), wherein the bath having the fixing faculty is a bleach-fixing solution.

(5) The method according to above item (2), wherein the photosensitive silver halide material for color photography has a silver content of 2 to 8 $g/m^2$.

(6) The method according to above item (2), wherein the bath having the fixing faculty is replenished in an amount of 100 to 550 $ml/m^2$.

DESCRIPTION OF THE PREFERRED EMBODIMENTS

The compounds of the above mentioned formula (I) are called "water-soluble thiourea compounds" and exemplified as stable fixing agents usable in place of thiosulfuric acid residue in J. P. KOKAI Nos. Hei 6-51473 and 6-51455 and French Patent NO. 1,245,937, and also as bleaching accelerators in J. P. KOKAI No. Hei 2-44355. However, it has not been expected at all that when such a compounmd is used for forming a bath having a fixing function as in the present invention, the accuracy of reading the magnetic record is improved and that when it is used in combination with thiosulfuric acid residue in a limited ratio, a more remarkable effect can be obtained.

The detailed description will be made on the compounds of the formula (I) of the present invention.

Examples of the alkyl, alkenyl, aralkyl, aryl and heterocyclic groups represented by X, Y, $R^1$, $R^2$, $R^3$, $R^4$, $R^5$, $R^6$ and $R^7$ in the formula (I) include substituted or unsubstituted alkyl groups having 1 to 10 carbon atoms (such as methyl, ethyl, propyl, hexyl, isopropyl, carboxyethyl, sulfoethyl, aminoethyl, dimethylaminoethyl, phosphonopropyl, carboxymethyl and hydroxyethyl groups), substituted or unsubstituted alkenyl groups having 2 to 10 carbon atoms (such as vinyl, propenyl and 1-methylvinyl groups), substitiuted or unsubstituted aralkyl groups having 7 to 12 carbon atoms (such as benzyl, phenethyl, 3-carboxyphenylmethyl and 4-sulfophenylethyl groups), substituted or unsubstituted aryl groups having 6 to 12 carbon atoms (such as phenyl, naphthyl, 4-carboxyphenyl and 3-sulfophenyl groups), and substituted or unsubstituted heterocyclic groups having 1 to 10 carbon atoms (preferably 5-membered or 6-membered ring groups such as pyridyl, furyl, thienyl, imidazolyl, pyrrolyl, pyrazolyl, pyrimidinyl, quinolyl, piperidyl and pyrrolidyl groups).

The cationic groups represented by $R^6$ and $R^7$ in the formula (I) are alkali metals and ammonium.

X and Y may together form a ring. The rings formed by X and Y include, for example, imidazoline-2-thion ring, imidazolidine-2-thion ring, thiazoline-2-thion ring, thiazolidine-2-thion ring, oxazoline-2-thion ring, oxazolidine-2-thion ring and pyrrolidine-2-thion ring, as well as benzo-condensed rings of them.

At least one of X and Y must be substituted with at least one of carboxylic acids or salts thereof (such as alkali metal salts and ammonium salts), sulfonic acids or salts thereof (such as alkali metal salts and ammonium salts), phosphonic acids or salts thereof (such as alkali metal salts and ammonium salts), amino groups (such as unsubstituted amino group, dimethylamino group, methylamino group and dimethylamino group hydrochlorides), ammonium groups (such as trimethylammonium group and dimethylbenzylammonium group) and hydroxyl group.

The alkyl, alkenyl, aralkyl, aryl and heterocyclic groups may be substituted.

The substituents are typified by, for example, alkyl groups, aralkyl groups, alkenyl groups, alkynyl groups, aryl groups, alkoxy groups, aryloxy groups, acylamino groups, ureido groups, urethane groups, sulfonylamino groups, sulfamoyl groups, carbamoyl groups, sulfonyl group, sulfinyl group, alkyloxycarbonyl groups, aryloxycarbonyl groups, acyl groups, acyloxy groups, alkylthio groups, arylthio groups, halogen atoms, cyano groups and nitro groups. These substituents may be further substituted. When each of the groups has two or more substituents, they may be the same or different from each other.

The compounds of the formula (I) are preferably those of the following formula (I-II):

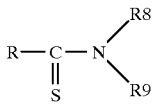

wherein R represents an alkyl group having 1 to 10 carbon atoms, —N($R^{10}$)$R^{11}$ group having 0 to 10 carbon atoms or —N($R^{12}$)N($R^{13}$)$R^{14}$ group having 0 to 10 carbon atoms; and $R^8$, $R^9$, $R^{10}$, $R^{11}$, $R^{12}$, $R^{13}$ and $R^{14}$ each represent a hydrogen atom or alkyl group, with the proviso that at least one of $R^8$, $R^9$, $R^{10}$, $R^{11}$, $R^{11}$, $R^{13}$ and $R^{14}$ represents an alkyl group substituted with a group selected from among carboxylic acids or salts thereof, sulfonic acids or salts thereof, phosphonic acids or salts thereof, amino groups, ammonium groups and hydroxyl group.

More preferably, R in the formula (I-II) represents —N($R^{10}$)$R^{11}$ having 0 to 6 carbon atoms or —N($R^{12}$)N($R^{13}$)$R^{14}$ having 0 to 6 carbon atoms. $R^8$, $R^9$, $R^{10}$, $R^{11}$, $R^{12}$, $R^{13}$ and $R^{14}$ each represent a hydrogen atom or alkyl group, with the proviso that at least one of $R^8$, $R^9$, $R^{10}$, $R^{11}$, $R^{12}$, $R^{13}$ and $R^{14}$ represents an alkyl group substituted with a group selected from among carboxylic acids, salts thereof, sulfonic acids and salts thereof.

The compounds of the formula (I-II) are preferably those represented by the following formula (I-III):

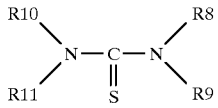

wherein $R^8$, $R^9$, $R^{10}$ and $R^{11}$ each represent a hydrogen atom or alkyl group, with the proviso that at least one of $R^8$, $R^9$, $R^{10}$ and $R^{11}$ represents an alkyl group substituted with a group selected from among sulfonic acids, salts thereof, carboxylic acids and salts thereof.

The total number of carbon atoms in the compound of the formula (I-III) is preferably 2 to 4, more preferably 2 or 3.

The compounds of the formula (I-III) are preferably those represented by the following formula (I-IV):

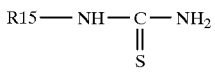

wherein $R^{15}$ represents an alkyl group substituted with at least one sulfonic acid or a salt thereof (such as an alkali metal salt or ammonium salt), a carboxylic acid or a salt thereof (such as alkali metal salt or ammonium salt), for example, sulfomethyl, sulfoethyl, carboxymethyl, carboxyethyl, sulfopropyl, carboxypropyl, 2-methylsulfoethyl or 2-methylcarboxyethyl group). It is preferred that $R^{15}$ represents an alkyl group substituted with one sulfonic acid or salt thereof (such as an alkali metal salt or ammonium salt).

Examples of the compounds of the formula (I) in the present invention will be given below, which by no means limit the invention.

I-1

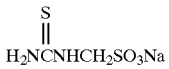

I-2

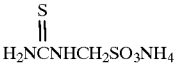

I-3

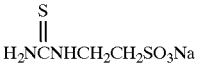

I-4

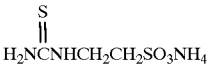

I-5

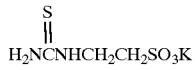

-continued

I-6

$H_2NC(=S)NHCH_2CH_2CH_2SO_3Na$

I-7

$H_2NC(=S)NHCH_2CH(CH_3)SO_3Na$

I-8

$H_2NC(=S)NHCH(CH_3)CH_2SO_3Na$

I-9

$H_2NC(=S)N(CH_3)CH_2CH_2SO_3Na$

I-10

$H_2NC(=S)N(CH_2SO_3Na)CH_2CH_2SO_3Na$

I-11

$CH_3NHC(=S)NHCH_2CH_2SO_3Na$

I-12

$CH_3NHC(=S)NHCH_2CH_2SO_3NH_4$

I-13

$CH_3CH_2NHC(=S)NHCH_2SO_3Na$

I-14

$(CH_3)_2NC(=S)NHCH_2SO_3Na$

I-15

$CH_3NHC(=S)N(CH_3)CH_2SO_3Na$

I-16

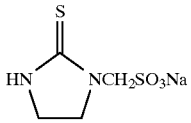

I-17

$NaO_3SCH_2NHC(=S)NHCH_2CH_2SO_3Na$

I-18

$H_2NC(=S)NHCH_2COOH$

I-19

$H_2NC(=S)NHCH_2COONa$

I-20

$H_2NC(=S)NHCH_2COOK$

-continued

I-21

$H_2NC(=S)NHCH_2COONH_4$

I-22

$H_2NC(=S)NHCH_2CH_2COOH$

I-23

$H_2NC(=S)NHCH_2CH_2COONH_4$

I-24

$H_2NC(=S)NHCH(CH_3)COOH$

I-25

$H_2NC(=S)NHCH(CH_3)COONa$

I-26

$CH_3NHC(=S)NHCH_2COOH$

I-27

$H_2NC(=S)N(CH_2COOH)CH_3$

I-28

$NaOC(=O)CH_2NHC(=S)NHCH_2SO_3Na$

I-29

$HOC(=O)CH_2NHC(=S)NHCH_2SO_3Na$

I-30

$H_2NC(=S)N(CH_2SO_3Na)CH_2COOH$

I-31

$HOCH_2NHC(=S)NHCH_2CH_2SO_3Na$

I-32

$H_2NCH_2CH_2NHC(=S)NHCH_2SO_3Na$

I-33

$HOCH_2CH_2NHC(=S)NHCH_2SO_3Na$

I-34

$H_2NC(=S)NHCH_2CH(NH_2)COOH$

I-35

$H_2NC(=S)NHCH(COOH)CH_2NH_2$

I-36

$H_2NC(=S)NHCH(COOH)CH_2OH$

-continued

I-37

$NaO_2SCH_2NHC(=S)NHCH_2CH_2SO_3Na$

I-38

$CH_3SCH_2NHC(=S)NHCH_2SO_3Na$

I-39

$(CH_3)_2N(CH_2)_2NC(=S)NH_2$

I-40

$H_2NC(=S)NHCH_2CH_2CH_2N(C_2H_5)_2$

I-41

$(CH_3)_2NC(=S)N(CH_3)CH_2COOH$

I-42

$CH_2NHC(=S)NHCH_2CH_2OH$

I-43

$NaO_3SCH_2CH_2NHC(=S)NHCH_2CH_2SO_3Na$

I-44

$NaOCCH_2NHC(=S)NHCH_2CH_2SO_3Na$

I-45

$NaOCCH_2CH_2NHC(=S)NHCH_2CH_2SO_3Na$

II-49

$H_2NC(=S)NHCH_2CH_2PO_3Na_2$

II-50

$CH_3NHC(=S)OCH_2CH_2N^+(CH_3)_3$ $Cl^-$

II-51

$CH_3C(=S)NHCH_2CH_2SO_3NH_4$

II-52

$(CH_3)_2NCH_2CH_2NHC(=S)OH$

II-53

$CH_3NHC(=S)SCH_2COOH$

-continued

II-54

$CH_2=CHCH_2NHC(=S)NHCH_2CH_2SO_3Na$

II-55

$H_2NC(=S)NHCH_2$ — $C_6H_4$ — $COOH$

II-56

$H_2NC(=S)NH$ — $C_6H_4$ — $SO_3Na$

II-55

$H_2NC(=S)NHCH_2CH_2N^+(CH_3)_3$ $Cl^-$

I-58

$C_2H_5NHC(=S)NH$ — $C_6H_4$ — $SO_3Na$

I-59

$C(=S)NHCH_2SO_3Na$ — $C_3H_2N_2$

I-60

$C_5H_4N$ — $NHC(=S)NHCH_2SO_3Na$

I-61

$CH_2=CHCH_2C(=S)NHCH_2SO_3Na$

I-62

$C_6H_5$ — $C(=S)NHCH_2CH_2COOH$

I-63

$H_2NNHC(=S)NHCH_2CH_2SO_3Na$

I-64

$H_2NNHC(=S)NHCH_2SO_3NH_4$

I-65

$H_2NN(CH_3)C(=S)NHCH_2COOH$

I-66

$(CH_3)_2NNHC(=S)NHCH_2CH_2PO_3Na_2$

-continued
I-67
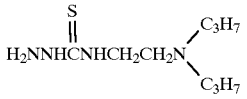
I-68
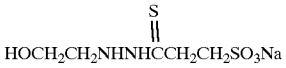
I-69
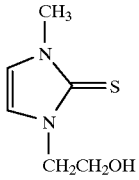
I-70
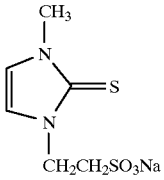
I-71
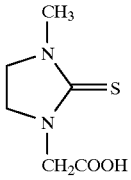
I-72
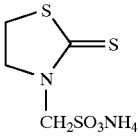
I-73
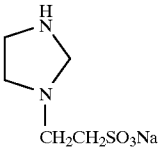
I-74
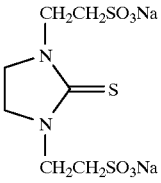
I-75
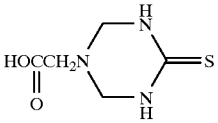
-continued
I-76
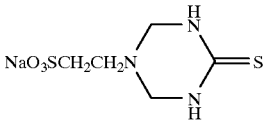
I-77
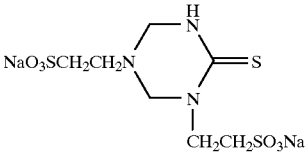
I-78
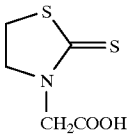
I-79
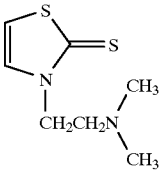
I-80
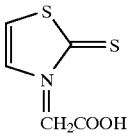
I-81
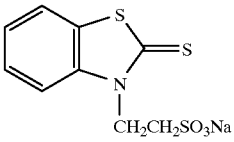
I-82
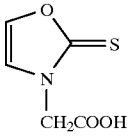
I-83
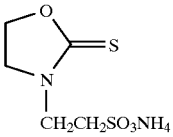
I-84
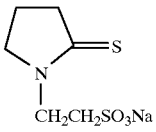
The compounds used in the present invention represented by the formula (I) can be synthesized by a known method such as that described in J. Org. Chem.,24, 470–473 (1959), J. Heterocycl. Chem., 4, 605 to 609 (1967), "Yakushi",82, 36 to 45 (1962), Japanese Patent Publication for Opposition Purpose (hereinafter referred to as "J. P. KOKOKU") No. sho 39-26203, J. P. KOKAI No. Sho 63-229449 and OLS-2,043,944.

When the compounds given above are used singly as the fixing agent in the fixing solution or bleach-fixing solution, they are used in an amount of 0.03 to 3 mol/l, preferably 0.05 to 2 mol/l.

It is most preferred in the present invention to use such a compound in combination with a thiosulfate. In this case, this compound is used in such an amount that the molar ratio of the compound to thiosulfate is about 0.05/1 to 0.3/1, preferably about 0.07/1 to 0.25/1 More specifically, an amount of the compound which varies depending on the amount of the thiosulfate used, as a matter of course, is preferably about 0.001 to 0.5 mol/l, more preferably about 0.05 to 0.3 mol/l.

Two or more of the compounds of the formula (I) may be used in the present invention. In such a case, the total amount of them is the most preferably in the range of the above-described molar ratio to the sulfate radical of the thiosulfate.

The details of the bath having fixing function used in the present invention will be described later.

The detailed description will be made on the magnetic recording layer used in the present invention. Magnetic particles are used as the recording medium in the magnetic recording layer. The magnetic particles usable in the present invention include ferromagnetic iron oxides ($FeO_x$; $4/3<x\leqq 3/2$) such as $\gamma$-$Fe_2O_3$, Co-coated ferromagnetic iron oxides ($FeO_x$ ; $43<x\leqq 3/2$) such as Co-coated $\gamma$-$Fe_2O_3$, Co-coated magnetites, other Co-containing ferromagnetic iron oxides, Co-containing magnetites, ferromagnetic chromium dioxide, ferromagnetic metals, ferromagnetic alloys, and other ferrites such as hexagonal Ba ferrite, Sr ferrite, Pb ferrite, Ca ferrite and solid solutions and ion-exchanged products of them. From the viewpoint of the transmission density, Co-coated ferromagnetic iron oxides having $Fe^{2+}/Fe^{3+}$ ratio of 0 to 10% such as Co-coated $\gamma$-$Fe_2O_3$ are preferred.

Methods for producing such a ferromagnetic powder have been known. The ferromagnetic substances used in the present invention can also be produced by the known methods.

The description will be made on the shape and size of the ferromagnetic substances. The shape may be any of needles, rice grain-shape, spheres, cubes, plates, etc. Among them, the needle-shaped substances are preferred from the viewpoint of the electromagnetic transduction characteristics. When the particles are in the form of needles, the length of the major axis is preferably 0.01 to 0.8 $\mu$m, and the ratio of the major axis/minor axis is preferably 2/1 to 100/1. More preferably, the major axis is 0.05 to 0.3 $\mu$m, and the ratio of the major axis/minor axis is 4/1 to 15/1. The specific surface area is preferably at least 20 $m^2/g$ ($S_{BET}$), particularly preferably at least 30 $m^2/g$.

The higher the saturation magnetization value ($\rho s$) of the ferromagnetic substance, the better. It is at least 50 emu/g, preferably at least 70 em/g and practically 100 emu/g or below. The squarness ratio ($\rho r/\rho s$) of the ferromagnetic substance is at least 40%, preferably at least 45% When the coercive force (Hc) is too low, it is easily erased and, on the contrary, when it is too high, the writing becomes impossible depending on the system. Therefore, the coercive force is preferably in the range of 200 Oe to 3000 Oe, more preferably 500 to 2,000 Oe and most preferably 650 to 950 Oe.

The ferromagnetic particles may be surface-treated with silica and/or alumina as described in J. P. KOKAI Nos. Sho 59-23505 and Hei 4-096052. These particles may also be surface-treated with an inorganic and/or organic material as described in J. P. KOKAI Nos. Hei 4-195726, 4-192116, 4-259911 and 5-081652. Further, the ferromagnetic particles may be surface-treated with a silane coupling agent or titanium coupling agent. The coupling agents include, for example, known materials described in J. P. KOKOKU No. Hei 1-261469 and also the following compounds:

Examples of Compounds:

[1]-1: Vinyltrichlorosilane,

[1]-2: Vinyltriethoxysilane,

[1]-3: $\gamma$-Methacryloxypropyltrimethoxysilane,

[1]-4: $\gamma$-Glycidoxypropyltrimethoxysilane,

[1]-5: N-$\beta$(Aminoethyl)-$\gamma$-aminopropylmethyldimethoxysilane,

[1]-6: N-Phenyl-$\gamma$-aminopropyltrimethoxysilane,

[1]-7: Vinyloctyltrimethoxysilane,

[1]-8: 10-(Vinyloxycarbonyl)nonyl trimethoxysilane,

[1]-9: p-Vinylphenyltriisopropylsilane,

[1]-10: 3-(Glycidyloxy)propyltriethoxysilane,

[1]-11: 3-(Acryloyl)propyltrimethoxysilane,

[1]-12: 11-(Methacryloyl)undecyl trimethoxysilane,

[1]-13: 3-Aminopropyltrimethoxysilane,

[1]-14: 3-Phenylaminopropyltrimethoxysilane,

[1]-15: 3-N,N-Dibutylaminopropyltrimethoxysilane,

[1]-16: 3-Triethylammoniopropyltrimethoxysilane iodide,

[1]-17: 3-Isocyanylpropyl methyldimethoxysilane,

[1]-18: 3-[Poly(degree of polymerization: 10)oxyethynyl) oxypropyl trimethoxysilane,

[1]-19: 3-methoxy[poly(degree of polymerization: 6)oxyethynyl)oxy-propyl trimethoxysilane, and

[1]-20: decyltrimethoxysilane.

Examples of Compounds:

[2]-1: Isopropyl triisostearoyl titanate,

[2]-2: Isopropyl tridodecylbenzenesulfonyl titanate,

[2]-3: Isopropyl tris(dioctylpyrophosphato) titanate,

[2]-4: Tetraisopropylbis(dioctylphosphito) titanate,

[2]-5: Tetraoctylbis(ditridecylphosphito) titanate,

[2]-6: Tetra( 2,2'-diallyloxymethyl-l-butyl)bis(di-tridecyl) phosphite titanate,

[2]-7: Bis(dioctylpyrophosphateoxyacetate titanate,

[2]-8: Bis(dioctylpyrophosphato) ethylene titanate,

[2]-9: Isopropyl trioctanoyl titanate,

[2]-10: Isopropyl dimethacryl isostearoyl titanate,

[2]-11: Isopropyl isostearoyl diacryl titanate,

[2]-12: Isopropyl tri(dioctylphosphato) titanate,

[2]-13: Isopropyl tricumylphenyl titanate,

[2]-14: Isopropyl tri(N-amidoethyl aminoethyl) titanate,

[2]-15: Dicumyl phenyloxyacetato titatate,

[2]-16: Diisostearoyl ethylene titanate,

The amount of the silane coupling agent or titanium coupling agent added to the magnetic particles is preferably 1.0 to 200% by weight. When the amount is smaller than 1.0% by weight, the stability of the solution is reduced and, on the contrary, when it exceeds 200% by weight, the stability of the solution is also reduced. It is more preferably 1 to 75% by weight and particularly 2 to 50% by weight.

The silane coupling agent or titanium coupling agent is added to the magnetic particles used in the present invention to treat the latter by a well known method. Thus, the surface of the particles can be modified to-make the magnetic material stable to the coating solution. Namely, the coupling agent is applied to the magnetic particles by the direct treating method of integral blending method. The direct method is roughly classified into dry method, slurry method and spray method. The magnetic material obtained by the direct treating method is excellent in that the coupling agent is added to a binder so that the surface of the magnetic particles can be surely modified with the coupling agent. In the direct methods, the dry method wherein the magnetic particles are homogeneously dispersed in an alcoholic aqueous solution, organic solvent or aqueous solution of the silane coupling agent and then dried is usually employed. It is preferred to use a stirring machine such as Henschel mixer, super mixer, ready mixer, twin-cylinder blender, open kneader or the like. Among them, the open kneader is particularly preferred. Preferably, the magnetic particles are mixed with a small amount of water or a water-containing organic solvent and a coupling agent, the resultant mixture is stirred by means of the open kneader to remove water and then further finely dispersed.

The slurry method is employed when a step of slurrying the magnetic particles is included in the production of the magnetic material. In this method, the coupling agent is added to the slurry. This method has a merit that the treatment can be conducted within the production steps. In the spray method, the coupling agent is added to the magnetic particles in a step of drying the magnetic material. Although this method has a merit that the treatment can be conducted within the production steps, it also has a demerit that the uniform treatment is difficult.

In the integral blend method, the coupling agent is added to the magnetic particles and binder, and they must be thoroughly kneaded. This method is simple and easy.

The description will be made on the binder suitable for the magnetic particles used in the present invention.

The binders usable in the present invention include known binders currently in use for magnetic recording media, such as thermoplastic resins, thermosetting resins, radiation-curable resins, reactive resins, polymers decomposable with an acid or alkali, biodegradable polymers, natural polymers (cellulose derivatives, saccharide derivatives, etc.) and mixtures of them.

Preferred Tg of these resins ranges from −40° C. to 300° C., and the weight-average molecular weight is 2,000 to 1,000,000, preferably 5,000 to 300,000.

The termoplastic resins include vinyl copolymers such as vinyl chloride/vinyl acetate copolymer, copolymers of vinyl chloride or vinyl acetate with vinyl alcohol, maleic acid and/or acrylic acid, vinyl chloride/vinylidene chloride copolymer, vinyl chloride/acrylonitrile copolymer and ethylene/vinyl acetate copolymer; cellulose derivatives such as nitrocellulose, cellulose diacetate, cellulose triacetate, cellulose acetate propionate, cellulose acetate butyrate, cellulose tripropionate and cellulose dodecanoate resins; acrylic resins; polyvinyl acetal resins; polyvinyl butyral resins; polyester polyurethane resins; polyether polyurethane resins; polycarbonate polyurethane resins; polyester resins; polyether resins; polyamide resins; amino resins; rubber resins such as styrene/butadiene resins and butadiene/acrylonitrile resins; silicone resins and fluororesins.

The thermosetting resins or reactive resins are those the molecular weight of which can be extremely increased by heating, such as phenolic resins, phenoxy resins, epoxy resins, curing polyurethane resins, urea resins, melamine resins, alkyd resins, silicone resins, acrylic reactive resins, epoxy/polyamide resins, nitrocellulose/melamine resins, mixtures of a high-molecular weight polyester resin and an isocyanate prepolymer, urea/formaldehyde resin, mixture of a low-molecular weight glycol/high-molecular weight diol/polyisocyanate, polyamine resins and mixtures of them.

The radiation-curing resins include those obtained by bonding a radiation-curable functional group having a carbon-to-carbon unsaturated bond to the above-described thermoplastic resins. Preferred functional groups include acryloyl and methacryloyl groups.

In the binders, cellulose diacetate is preferred.

From the viewpoints of the dispersibility and durability of the magnetic substance, it is desirable to introduce a polar group (such as epoxy group, $CO_2M$, OH, $NR_2$, $NR_3X$, $SO_3M$, $OSO_3M$, $PO_3M_2$ or $OPO_3M_2$, wherein M's may be the same or different from each other and they each represent a hydrogen, alkali metal or ammonium, and R represents a hydrogen or alkyl group) into the binders. The polar group content is preferably $10^{-7}$ to $10^{-3}$ equivalent, more preferably $10^{-6}$ to $10^{-4}$ equivalent, per gram of the polymer.

The above-described binders are used either singly or in the form of a mixture of two or more of theme. They can be cured by adding a known crosslinking agent such as an epoxy, aziridine or isocyanate crosslinking agent and/or a radiation-curable vinyl monomer.

The isocyanate crosslinking agents include polyisocyanates having two or more isocyanato groups such as tolylene diisodyanate, 4,4'-diphenylmethane diisocyanate, hexamethylene diisocyanate, xylylene diisocyanate, naphthylene-1,5-diisocyanate, o-toluidine diisocyanate, isophorone diisocyanate and triphenylmethane diisocyanate; reaction products of such an isocyanate with a polyalcohol (such as a reaction product of 3 mol of tolylene diisocyanate with 1 mol of trimethylolpropane) and polyisocyanates formed by the condensation of such an isocyanate.

The radiation-curable vinyl monomers are compounds polymerizable by the radiation and having at least one carbon-to-carbon unsaturated bond in the molecule such as (meth)acrylic esters, (meth)acrylamides, allyl compounds, vinyl esters, vinyl heterocyclic compounds, N-vinyl compounds, styrene, (meth)acrylic acid, crotonic acid, itaconic acid and olefinic acids. Among them, preferred are those having at least two (meth)acryloyl groups such as polyethylene glycol (meth)acrylates, e.g. diethylene glycol di(meth)acrylate and triethylene glycol di(meth)-acrylate, trimethylolpropane tri(meth)acrylate, pentaerythritol tetra (meth)acrylate, dipentaerythritol penta(meth)acrylate, dipentaerythritol hexa(meth)acrylate and a reaction product of a polyisocyanate and a hydroxy(meth)acrylate compound.

Such a crosslinking agent is used in an amount of preferably 5 to 45% by weight based on the whole binder including the crosslinking agent.

A hydrophilic binder is also usable for the magnetic recording layer in the present invention.

The hydrophilic binders usable herein are those described in Research Disclosure No. 17643, page 26, and No. 18716, page 651, such as water-soluble polymers, cellulose esters, latex polymers and water-soluble polyesters. The water-soluble polymers include, for example, gelatin, gelatin derivatives, casein, agar, sodium alginate, starch, polyvinyl alcohols, polyacrylic acid copolymers and maleic anhydride copolymers. The cellulose esters include, for example, carboxymethylcellulose and hydroxyethylcellulose. The latex polymers include, for example, vinyl chloride-containing copolymers, vinylidene chloride-containing copolymers, acrylic ester-containing copolymers, vinyl acetate-containing copolymers and butadiene-containing copolymers. Among them, gelatin is the most preferred.

The gelatin may be any of so-called "alkali-treated (lime-treated) gelatin prepared by immersion in an alkali bath before the extraction, acid-treated gelatin prepared by immersion in an acid bath, double-immersed gelatin prepared by immersion in both baths and gelatin treated with an enzyme. If necessary, a part of the gelatin may be replaced with albumin, casein, a cellulose derivative such as carboxymethylcellulose or hydroxyethylcellulose, a saccharide derivative such as agar, sodium alginate, starch derivatives or dextran, a synthetic hydrophilic colloid such as polyvinyl alcohol, poly-N-vinylpyrrolidone, polyacrylic acid copolymer, polyacrylamide or a derivative or partial hydrolyzate thereof, or a gelatin derivative.

The gelatin-containing magnetic recording material is preferably hardened. Hardening agents usable for the magnetic recording layer include aldehyde compounds such as formaldehyde and glutaraldehyde; ketone compounds such as diacetyl and cyclopentanedion; bis(2-chloroethylurea); 2-hydroxy-4,6-dichloro-1,3,5-triazine; compounds having a reactive halogen described in, for example, U.S. Pat. Nos. 3,288,775 and 2,732,303 and British Patent Nos. 974,723 and 1,167,207; divinyl sulfone; 5-acetyl-1,3-diacryloylhexahydro-1,3,5-triazine; compounds having a reactive olefin as described in, for example, U.S. Pat. Nos. 3,635,718 and 3,232,763 and British Patent No. 994,869; N-hydroxymethylphthalimide; N-methylol compounds described in, for example, U.S. Pat. Nos. 2,732,316 and 2,586,168; isocyanates described in, for example, U.S. Pat. No. 3,103,437; aziridine compounds described in, for example, U.S. Pat. Nos. 3,017,280 and 2,983,611; acid derivatives described in, for example, U.S. Pat. Nos. 2,725,294 and 2,725,295; epoxy compounds described in, for example, U.S. Pat. No. 3,091,537; and halogenated carboxyaldehydes such as mucochloric acid. Further, inorganic compounds usable as the hardening agent include chromium alum; zirconium sulfate; and carboxyl group-active type hardening agents described in, for example, J. P. KOKOKU Nos. Sho 56-12853 and 58-32699, Belgian Patent No. 825,726, J. P. KOKAI Nos. Sho 60-225148 and 51-126125, J. P. KOKOKU No. Sho 58-50699, J. P. KOKAI No. Sho 52-54427 and U.S. Pat. No. 3,321,313.

The hardening agent is used in an amount of usually 0.01 to 30% by weight, preferably 0.05 to 20% by weight, based on the dry gelatin.

The magnetic substance can be dispersed in the binder by various known techniques as described in, for example, Japanese Patent Application No. Hei 4-189652. The means used therefor include a kneader, pin-type mill, annular mill, etc. A combination of the kneader with the pin-type mill or a combination of the kneader with the annular mill is also preferred. The kneaders include those of open type, closed type and continuous type. Further, triple-roll mill, lab-plastomill, etc. are also usable. In the dispersion, dispersants described in J. P. KOKAI No. Hei 5-088283 and other known dispersants are usable.

The thickness of the magnetic recording layer is 0.1 to 10 $\mu$m, preferably 0.2 to 5 $\mu$m and more preferably 0.3 to 3 $\mu$m.

The weight ratio of the magnetic particles to the binder is preferably 0.5:100 to 60:100, more preferably 1:100 to 30:100.

The amount of the magnetic substance used for coating is 0.005 to 3 g/m$^2$, preferably 0.01 to 2 g/m$^2$ and more preferably 0.02 to 0.5 g/m$^2$ .

The magnetic recording layer of the present invention can be formed in stripes or over the whole surface of the back of the photograhic support by coating or printing. It is also preferred that the binder solution containing the magnetic particles dispersed therein and the binder solution for forming the support are spread together on the whole surface or in stripes to form the support having the magnetic recording layer. Although the compositions of the two kinds of polymers may be different from each other, they are preferably the same.

The magnetic recording layer can be formed by, for example, air doctor coating, blade coating, air knife coating, sqeeze coating, impregnation coating, reverse roll coating, transfer roll coating, gravure coating, kiss coating, cast coating, spray coating, dip coating, bar coating or extrusion coating method. Other methods can also be employed. The detailed description of them is given in (Coating Engineering)" pages 253 to 277 (published on Mar. 20, 1971).

The magnetic material in the magnetic recording layer thus formed on the support by the above-described coating method is oriented while the magnetic material in the layer is immediately drying, if necessary, and then the layer is dried. In this step, the support-carrying speed is usually 2 m/min to 500 m/min, and the drying temperature is controlled in the range of 20 to 250° C. The magnetic substance is oriented with a permanent magnet or solenoid. The strength of the permanent magnet is preferably at least 2,000 Oe, particularly at least 3,000 Oe. The strength of the solenoid may be higher than 500 Oe. During the drying, the orientation is conducted desirably when 5 to 70% of the solvent remains in the mangetic recording layer as described in Japanese Patent Application No. Hei 5-005822. If necessary, the surface is lubricated to obtain the magnetic recording layer of the present invention. The details are described in, for example, J. P. KOKOKU Nos. Sho 40-23625 and 39-28368 and U.S. Pat. No. 3,473,960. A method described in J. P. KOKOKU No. Sho 41-13181 is considered to be the fundamental and important technique in this technical field.

The magnetic recording layer may have also other functions such as lubricity-improving, curl-controlling, antistatic, adhesion-inhibiting and head-abrading functions or, alternatively, other functional layers may be formed to exhibit these functions. If necessary, a protective layer adjacent to the mangetic recording layer may be formed to improve the scarring resistance. It is preferred to add inorganic or organic fine particles (such as fine particles of silica, $SiO_2$, $SnO_2$, $Al_2O_3$, $TiO_2$, crosslinked polymethyl methacrylate, barium carbonate and silicone).

For example, an additive is incorporated into the magnetic recording layer to form projections of 0.8 $\mu$m or below on the surface of the back layer so that a magnetic outlet error due to contaminants at the time of magnetic input or output is prevented and S/N which is one of the magnetic characteristics is not impaired while the photographic properties are not influenced. The surface projections can be formed on the back by adding particles to the back surface, by causing the brushing at the time of the coating and drying or by intentionally forming Benard cell. The addition of the particles to the surface of the back is preferred so as to freely control the shape of the surface projections.

The particles to be added are insoluble in the developer. They can be inorganic fine particles, polymer particles, crosslinked polymer particles, etc. The inorganic particles usable in the present invention include fine powders of inorganic substances such as barium sulfate, manganese colloid, titanium dioxide, strontium barium sulfate and silicon dioxide, as well as silicon dioxide such as synthetic silica obtained by, for example, the wet method or by gelling silicic acid, and titanium dioxide (rutile or anatase type) formed from a titanium slag and sulfuric acid. The fine particles can be obtained also by pulverising an inorganic substance having a relatively large diameter such as 20 μm or longer and then classifying the particles (by vibration filtration, pneumatic classification or the like).

The polymeric compounds include polytetrafluoroethylene, cellulose acetate, polystyrene, polymethyl methacrylate, polypropyl methacrylate, polymethyl acrylate, polyethylene carbonate, starch and particles obtained by pulverizing them and classifying the powder. The polymeric compounds may be also those obtained by pulverizing polymers of one or more monomers by various methods such as suspension polymerization method, spray drying method or dispersion method, the monomers being acrylic esters, methacrylic esters, itaconic diesters, crotonic esters, maleic diesters, phthalic diesters, styrene derivatives, vinyl esters, acrylamides, vinyl ethers, allyl compounds, vinyl ketones, vinyl heterocyclic compounds, acrylonitrile, methacrylonitrile, polyfunctional monomers, siloxane terpolymers, benzoguanamine/formaldehyde condensate, benzoguanamine/melamine/formaldehyde condensate and melamine/formaldehyde condensate.

So as to prevent the photographic properties from impairment, the average diameter of the particles is preferably 0.1 to 1 μm and the amount of them to be applied is preferably 1 to 100 mg/m$^2$.

It is more preferred that at least one kind of the particles is aspherical inorganic particles having a Moh's scale of hardness of 5 or higher so that the contaminant staining the magnetic head can be cleaned.

The aspherical inorganic particles are preferably fine powders of metal oxides such as aluminum oxides (α-alumina, γ-alumina, corundum, etc.), chromium oxide ($Cr_2O_3$), iron oxide ($\alpha$-$Fe_2O_3$), silicon dioxide and titanium dioxide; carbides such as silicon carbide (SiC) and titanium carbide; and diamond. Among them, aluminum oxides and chromium oxide ($Cr_2O_3$) are recommended. The aspherical inorganic particles may be added to the magnetic layer or this layer may be overcoated with the particles. The binder to be used in this case may be that described above as the magnetic layer binder. The binder is preferably the same as that used for the magnetic layer.

The detailed description will be made on the transparent support used in the present invention.

Although triacetylcellulose or a polyethylene terephthalate practically used hitherto for forming a color film is usable for forming the transparent support in the present invention, a polyethylene aromatic dicarboxylate polyester support is the most desirable from the viewpoint of the magnetic recording properties.

Although the polyester used in the present invention is formed from a diol and an aromatic dicarboxylic acid as the indispensable components, other dicarboxylic acids are also usable. The dibasic acids usable herein include, for example, terephthalic acid, isophthalic acid, phthalic acid, phthalic anhydride, naphthalenedicarboxylic acids (2,6-, 1,5- 1,4- and 2,7-), diphenylene p,p'-dicarboxylic acid, tetrachlorophthalic anhydride, succinic acid, glutaric acid, adipic acid, sebacic acid, succinic anhydride, maleic acid, fumaric acid, maleic anhydride, itaconic acid, citraconic anhydride, tetra-hydrophthalic anhydride, 3,6-endomethylenetetrahydrophthalic anhydride, 1,4-cyclohexanedicarboxylic acid, halogenated terephthalic acids, bis(p-carboxyphenol) ether, 1,1-dicarboxy-2-phenylethylene, 1,4-dicarboxy-methylphenol, 1,3-dicarboxy-5-phenylphenol and sodium 3-sulfoisophahalate. The aromatic dicarboxylic acids as the indispensable component are those having at least one benzene nucleus among the above-described dicarboxylic acids.

The diols include, for example, ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol, dimethylolnaphthalene, p-hydroxyethylhydroxybenzene and bisphenol A.

The polyester may be copolymerized, if necessary, with a monofunctional or polyfunctional (at least trifunctional) hydroxyl group-containing compound or acid-containing compound. Further, the polyester of the present invention may be copolymerized with a compound having both hydroxyl group and carboxyl group (or an ester thereof) in the molecule, such as salicylic acid.

As for the monomeric diols and dicarboxylic acids, preferred aromatic dicarboxylic acids include 2,6-naphthalenedicarboxylic acid (NDCA), terephthalic acid (TPA), isophthalic acid (IPA), o-phthalic acid (OPA), p-phenylenedicarboxylic acid (PPDC); and the diols include (poly)ethyleneglycol (PEG or EG), cyclohexanedimethanol (CHDM), neopentyl glycol (NPG), bishenol A (BPA) and biphenol (BP). The hydroxycarboxylic acids usable as the copolymer components include p-hydroxybenzoic acid (PHBA) and 6-hydroxy-2-naphthalenecarboxylic acid (HNCA).

Among them, preferred polymers include homopolymers such as polyethylene terephthalate, polyethylene naphthalate, poly-cyclohexanedimethanol terephthalate (PCT); and copolymers such as a copolymer of terephthalic acid, naphthalenedicarboxylic acid and ethylene glycol (the mixing molar ratio of terephthalic acid to naphthalenedicarboxylic acid being preferably in the range of 0.9:1 to 0.1:0.9, more preferably 0.8:0.2 to 0.2:0.8), copolymer of terephthalic acid, ethylene glycol and bisphenol A (the mixing molar ratio of ethylene glycol to bishenol A being preferably in the range of 0.6:0.4 to 0:1.0, more preferably 0.5:0.5 to 0.1:0.9), copolymer of isophthalic acid, p-phenylenedicarboxylic acid, terephthalic acid and ethylene glycol (the amounts of isophthalic acid and p-phenylenedicarboxylic acid being 0.1 to 0.5 mol and 0.1 to 0.5 mol, preferably 0.2 to 0.3 and 0.2 to 0.3 mol, respectively, per mol of terephthalic acid), copolymer of terephthalic acid, neopentyl glycol and ethylene glycol (the molar ratio of neopentyl glycol to ethylene glycol being preferably 1:0 to 0.7:0.3, more preferably 0.9:0.1 to 0.6:0.4), copolymer of terephthalic acid, ethylene glycol and biphenol (the molar ratio of ethylene glycol to biphenol being preferably 0:1.0 to 08:0.2, more preferably 0.1:0.9 to 0.7:0.3), and copolymer of p-hydroxybenzoic acid, ethylene glycol and terephthalic acid (the molar ratio of p-hydroxybenzoic acid to ethylene glycol being preferably 1:0 to 0.1:0.9, more preferably 0.9:0.1 to 0.2:0.8). Among them, particularly preferred are the polyesters containing 2,6-naphthalenedicarboxylic acid, more specific polyesters containing 0.1 to 1.0 of 2,6-naphthalenedicarboxylic acid as a comonomer. Among them, polyethylene 2,6-naphthalate is the most preferred.

These homopolymers and copolymers can be synthesized by a known process for producing polyesters. For example, an acid component is directly esterified with a glycol component. When a dialkyl ester is used as the acid component, it is transesterified with the glycol component, and then the reaction mixture is heated under reduced pressure to remove excess glycol component. Alternatively, the acid component in the form of an acid halide may be reacted with glycol. If necessary, a transesterification catalyst or polymerization reaction catalyst and thermal stabilizer can be used. These processes for synthesizing the polyesters can be conducted with reference to, for example, "Kobunshi Jikken-gaku", Vol. 5, "Polycendensation and polyaddition" (published by Kyoritsu Shuppan in 1980), pages 103 to 136 and "Gesei Kobunshi (Synthetic Polymer) V" (published by Asakura Shoten in 1971), pages 187 to 286.

The preferred average molecular weight of these polyesters is in the range of about 5,000 to 200,000.

In order to improve the adhesion of such a polyester to another kind of polyester, the former can be blended with a part of the latter, copolymerized with a monomer constituting the latter or copolymerized with a monomer having an unsaturated bond to conduct the radical crosslinking.

The polymer blend comprising the mixture of two or more kinds of the polymers can be easily formed by a method described in J. P. KOKAI Nos. Sho 49-5482, Sho 64-4325 and Hei 3-192718, and Research Disclosure Nos. 283, 739-41, 284, 779-82, 294 and 807-14.

The polyester of the present invention has a Tg of not below 50° C. However, from the viewpoint of the safety, it is preferably not below 55° C., since the polyester is usually used without a sufficient attention and particularly in midsummer, it is exposed to a temperature of up to 40° C. outside. Thus, Tg of the polyester of the present invention is preferably not below 55° C., more preferably not below 60° C. and particularly not below 70° C. for safety. Most desirably, Tg is not below 90° C. on the principle of safety first. Namely, the polyester having a glass transition temperature above 40° C. (the temperature in midsummer; the severe condition for the polyester usually used by the users) is preferred, since the effect in inhibiting the curling by the heat treatment disappears at a temperature above the glass transition temperature.

The following compounds are examples of the polyesters used in the present invention, which by no means limit the invention.

Examples of polyester compounds:

| | | |
|---|---|---|
| P-O: | [terephthalic acid (TPA)/ethylene glycol (EG) (100/100)] (PET) | Tg = 80° C. |
| P-1: | [2,6-naphthalenedicarboxylic acid (NDCA)/ethylene glycol (EG) (100/100)] (PEN) | Tg = 119° C. |
| P-2: | [terephthalic acid (TPA)/cyclohexanedimethanol (CHDM) (100/100)] | Tg = 93° C. |
| P-3: | [TPA/bisphenol A (BPA) (100/100)] | Tg = 192° C. |
| P-4: | 2,6-NDCA/TPA/EG (50/50/100) | Tg = 92° C. |
| P-5: | 2,6-NDCA/TPA/EG (75/25/100) | Tg = 102° C. |
| P-6: | 2,6-NDCA/TPA/EG/BPA (50/50/75/25) | Tg = 112° C. |
| P-7: | TPA/EG/BPA (100/50/50) | Tg = 105° C. |
| P-8: | TPA/EG BPA (100/25/75) | Tg = 135° C. |
| P-9: | TPA/EG/CHDM/BPA (100/25/25/50) | Tg = 115° C. |
| P-10: | IPA/PPDC/TPA/EG (20/50/30/100) | Tg = 95° C. |
| P-11: | NDCA/NPG/EG (100/70/30) | Tg = 105° C. |
| P-12: | TPA/EG/BP (100/20/80) | Tg = 115° C. |
| P-13: | PHBA/EG/TPA (200/100/100) | Tg = 125° C. |
| P-14: | PEN/PET (60/40) | Tg = 95° C. |
| P-15: | PEN/PET (80/20) | Tg = 104° C. |
| P-16: | PAr/PEN (50/50) | Tg = 142° C. |
| P-17: | PAr/PCT (50/50) | Tg = 118° C. |
| P-18: | PAr/PET (60/40) | Tg = 101° C. |
| P-19: | PEN/PET/PAr (50/25/25) | Tg = 108° C. |
| P-20: | TPA/5-sulfoisophthalic acid (SIP)/EG (95/5/100) | Tg = 65° C. |
| P-21: | PEN/SIP/EG (99/1/100) | Tg = 115° C. |

The thickness of the support of the present invention is in the range of 50 to 300, μm. When it is below 50 μm, it is not resistant to the contraction stress of the photosensitive layers in the drying step and, on the contrary, when it is above 300 μm, the object of the invention to make the support thinner so as to compact the photosensitive material cannot be attained. From the viewpoint of the toughness, the thicker the better. Thus, the thickness of the support is preferably 50 to 200 μm, more preferably 80 to 115 μm, and particularly 85 to 105 μm.

All the polyesters of the present invention as described above have a flexural modulus higher than that of TAC to make it possible to attain the object of the invention, i.e. thinning of the film. Among them, PET and PEN have a particularly high flexural modulus, and by using PET or PEN, the film thickness can be reduced to 105 μm, though at least 122 μm thickness was necessitated for TAC.

The polyester support of the present invention is characterized by being heat-treated. The heat treatment must be conducted at a temperature ranging from 40° C. to the glass transition temperature for 0.1 to 1,500 hours. The higher the temperature of the heat treatment, the more rapidly the effect is obtained. However, when the heat treatment temperature is above the glass transition temperature, the obtained film is easily curled. Thus, the heat treatment should be conducted at a temperature not above the glass transition temperature.

The heat treatment is conducted at a temperature of at least 40° C. and below Tg, preferably at least Tg−20° C. and below Tg. When the temperature is below 40° C., a long time is necessitated for obtaining a sufficient curling effect to reduce the industrial productivity.

The heat treatment may be conducted at a given temperature within the above-described range. The heat treatment may be conducted under cooling. In such a case, the average cooling rate is −0.01 to −-20° C./h, preferably 0.1 to −5° C/h.

The heat treatment time ranges from 0.1 to 1,500 hours, preferably 0.5 to 200 hours. When the heat treatment time is below 0.1 hours, the sufficient effect cannot be obtained and, on the contrary, even when the reaction time is prolonged for longer than 1,500 hours, the effect reaches the saturation and, in addition, the support is easily colored and embrittled.

In order to further improve the effect of overcoming the curing properties, the support may be heat-treated at a temperature of at the lowest Tg and below the melting point (melting temperature determined with DSC) to eliminate the thermal history of the support and then the heat treatment is conducted again at a temperature in the range of 40° C. to lower than Tg.

In the present invention, this heat treatment is called "pre-heat treatment" which is distinguished from the heat treatment called "after-heat treatment" which is conducted at a temperature of 40° C. to lower than Tg as described in the preceding paragraph.

The pre-heat treatment is conducted preferably at a temperature of at the lowest Tg and below the melting point, more preferably from Tg+20° C. to the crystallization temperature (crystallization temperature determined with DSC). When the pre-heat treatment is conducted at the melting point or a higher temperature, the elasticity of the support is seriously reduced to impair the surface condition and transportability. The pre-heat treatment may be conducted at a fixed temperature (fixed-temperature pre-heat treatment) in this temperature range, or it may be conducted while the temperature is lowered (temperature-lowering pre-heat treatment) or while the temperature is elevated (temperature-elevating pre-heat treatment).

The pre-heat treatment time ranges from 0.1 minute to 1,500 hours, preferably from 1 minute to 1 hour. When the pre-heat treatment time is shorter than 0.1 minute, the sufficient effect cannot be obtained and, on the contrary, even when it is longer than 1,500 hours, the effect reaches the saturation and, in addition, the support is easily colored and embrittled.

The pre-heat treatment is followed by the after-heat treatment. After the pre-heat treatment, the temperature may be rapidly lowered to the after-heat treatment initiation temperature or it may be slowly lowered to the latter through Tg. In still another embodiment, the temperature may be once lowered to room temperature and then elevated to the after-heat treatment temperature.

Although the pre-heat treatment can be combined with the after-heat treatment in several patterns, the most preferred pattern comprises the fixed-temperature pre-heat treatment conducted at a temperature ranging from Tg+20° C. to the crystallization temperature followed by the after-heat treatment conducted while the temperature is lowered at a rate of −0.1 to −5° C./h to a temperature in the range of Tg to Tg−20 C.

The support may be heat-treated in the form of a roll or while it is transported in the form of a web.

When the support is heat-treated in the form of the roll, (1) it may be heat-treated from room temperature in a constant temperature bath, or (2) the temperature of the support in the form of the web is made constant while it is transported and then it is rolled and heat-treated. The method (1) has a merit that the cost of equipment can be kept low, while a time is necessitated for elevating and lowering the temperature. The merit of the method (2) is that the temperature-elevation time is unnecessary, while a high-temperature winding means is necessitated.

In the heat treatment of the support in the form of the roll, the support is easily wrinkled by the rolling and surface condition troubles such as transfer of cut portion in the roll core are inclined to be caused by the heat shrinkage stress. Therefore, it is desirable to come up with some ideas such as that the surface is roughened (by, for example, application of fine particles of a conductive inorganic substance such as $SnO_2$ or $Sb_2O_5$) so as to reduce the friction of the support and to prevent the wrinkle formation by rolling or that the ends of the support are knurled so as to slightly raise only the ends and to prevent the transfer of cut portion in the roll core.

On the other hand, when the support in the form of the web is heat-treated, the support surface condition more excellent than that obtained by the heat treatment of the roll can be obtained, though a long after-heat treatment step is necessitated.

Among these heat treatment methods, a preferred method comprises conducting the pre-heat treatment of the support in the form of the web and the after-heat treatment thereof in the form of the roll, since when the pre-heat treatment is conducted in the form of the web, the surface condition troubles are less than those occurred when the treatment is conducted in the form of the roll and the after-heat treatment necessitates a relatively long time.

These heat treatments may be conducted in any stage such as after the formation of the support film, after the glow discharge treatment, after the formation of the back layer (such as antistatic agent or lubricating agent) or after the subbing. The heat treatments are conducted preferably after the application of the antistatic agent so that the support can be prevented from the adhesion of dusts due to the electrification which causes the surface condition troubles of the support in the course of the heat treatments.

In the heat treatment of the polyester in the present invention, it is preferred to previously heat the polyester at a temperature of Tg or higher for a short time (preferably at Tg+20° C. to Tg+100° C. for 5 minutes to 3 hours) so as to reduce the time. The roll core used in the heat treatment is preferably hollow so as to efficiently transfer the heat to the film or it contains an electric heater therein or it has such a structure that a high-temperature liquid can flow therein. Although the material of the roll core is not particularly limited, it is preferably such that the strength thereof is not reduced by heat or it is not deformed by heat. It is, for example, stainless steel or a glass fiber-containing resin.

Various additives are preferably incorporated into the polyester of the present invention in order to further improve the function of the photographic support.

An ultraviolet absorber may be kneaded into the polyester film for the purpose of preventing the fluorescence or improving the storability. The ultraviolet absorber is desirably such that it is free from absorption in the visible ray region. The amount of the ultraviolet absorber is usually about 0.01 to 20% by weight, preferably 0.05 to 10% by weight based on the polyester film. When it is below 0.01% by weight, the effect of inhibiting the deterioration by ultraviolet rays cannot be expected. The ultraviolet absorbers include, for example, benzophenones such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone and 2,2'-dihydroxy-4,4'-dimethoxybenzophenone; benzotriazoles such as 2(2'-hydroxy-5-methylphenyl) benzotriazole, 2(2'-hydroxy-3',5'-di-t-butylphenyl) benzotriazole and 2(2'-hydroxy-3'-di-t-butyl-5'-methylphenyl)benzotriazole; and salicylates such as phenyl salicylate and methyl salicylate.

The refractive index of the preferred aromatic polyester of the present invention is as high as 1.6 to 1.7, while that of the gelatin which is the main component of the photosensitive layer to be formed thereon is as low as 1.50 to 1.55. Therefore, a light incident through the film edge easily reflects on the interface between the base and the emulsion layers. Thus, the polyester film causes a so-called "light-piping phenomenon".

The light-piping phenomenon can be prevented by a known method such as a method wherein inert inorganic particles are incorporated into the support or a method wherein a dye is added to the supoprt. The preferred method for preventing the light-piping in the present invention comprises the addition of a dye which inhibits the serious increase of the film haze.

Although the dye used for dyeing the film is not particularly limited, the color tone is preferably gray from the general properties of the photosensitive material, and the dye is preferably such that it has a high thermal resistance in the polyester film-forming temperature zone and a high compatibility with the polyester.

From the above-described viewpoint, the object can be attained by mixing dyes available as dyes for polyesters such as Diaresin (a product of Mitsubishi Chemical Industries Ltd.) and Kayaset (a product of Nippon Kayaku Co., Ltd.).

The color density after the coloring must be at least 0.01, preferably at least 0.3 in the visible ray region as determined with a color densitometer (a product of Macbeth).

The polyester film according to the present invention can be made lubricious depending on the use thereof. Although the means for making the film lubricious is not particularly limited, the lubrication is conducted usually by kneading an inert inorganic compound therein or by applying a surfactant thereto.

Examples of the inert inorganic particles include $SiO_2$, $TiO_2$, $BaSO_4$, $CaCO_3$, talc and kaolin. The means for the lubrication is not limited to the external particle-incorporation method wherein the inert particles are added to the polyester-synthesizing reaction system but it also includes an internal particle-incorporation method wherein, for example, a catalyst added at the time of the polymerization reaction for forming the polyester is precipitated.

Although the means for the lubrication is not particularly limited, it is desirable that $SiO_2$ having a refractive index relatively close to that of the polyester film is selected in the external particle-incorporation method or that the internal particle-incorporation method wherein the diameter of the precipitated particles can be made relatively small is employed, since the transparency is important for the support for the photosensitive material for photography.

It is also preferred to form a layer having a necessitated function in order to further increase the transparency of the film when the lubrication is conducted by the kneading. Examples of this method include a co-extrusion method wherein two or more extrusion machines and a feed block or multimanifold dye are used.

When such a polyester film is used as the support, it is very difficult to fimly adhere a photographic layer (such as a sensitive silver halide emulsion layer, intermediate layer or filter layer) comprising a protective colloid mainly comprising gelatin to the support, since the polyester support has hydrophobic surfaces. Such a problem has been solved by the following two methods hitherto:

(1) a method wherein the surface of the support is activated by, for example, a chemical tretment, mechanical treatment, corona discharge treatment, flame treatment, ultraviolet treatment, high-frequency treatment, glow discharge treatment, active plasma treatment laser treatment, mixed-acid treatment or ozone oxidation treatment and then a photographic emulsion is directly applied to the surface to attain the adhesion, and (2) a method wherein a subbing layer is formed after the surface is once treated or without the surface treatment, and then the photographic emulsion layer is formed by the coating (see, for example, U.S. Pat. Nos. 2,698,241, 2,764,520, 2,864,755, 3,462,335, 3,475,193, 3,143, 421, 3,501,301, 3,460,944 and 3,674,531, British Patent Nos. 788,365, 804,005 and 891,469, and J. P. KOKOKU Nos. Sho 48-43122 and 51-446).

The surface treatment is considered to be conducted by thus forming some polar groups on the surface of the support which is essentially hydrophobic or by increasing the crosslinking density on the surface. As a result, the affinity of the components contained in the subbing layer-forming solution for the polar groups is improved or the fastness of the adhesion surface is improved. Further, the adhesion mechanism by the formation of the radicals is also possible.

Various ideas were proposed for the structure of the subbing layer(s). Namely, two methods were proposed, i.e. a so-called superposition method wherein the first layer (hereinafter referred to as "the first subbing layer") firmly adherent to the support is formed and then a hydrophilic resin layer (hereinafter referred to as "the second subbing layer") firmly adherent to the photographic layer is formed thereon, and a single-layer method wherein only one layer comprising a resin having both hydrophobic group and hydrophilic group is formed.

Among the above-described surface treatments, preferred are the ultraviolet treatment, flame treatment, corona discharge treatment and glow discharge treatment.

The description will be made on the ultraviolet irradiation treatment. This treatment is conducted preferably by a method described in J. P. KOKOKU Nos. Sho 43-2603, 43-2604 or 45-3828. The mercury lamp is preferably a high-pressure mercury lamp comprising a quartz tube, and the ultraviolet wave length is preferably in the range of 180 to 320 nm. The ultraviolet irradiation may be conducted in the step of stretching the support, in the thermal fixing step or after the thermal fixation.

As for the irradiation with the violet rays, a high-pressure mercury lamp having a main wave length of 365 nm is usable as the light source so far as the elevation of the surface temperature of the substance to be supported to around 150° C. is not harmful to the properties of the support. When the low-temperature process is necessitated, a low-pressure mercury lamp having the main wave length of 254 nm is preferred. A high-pressure mercury lamp of ozoneless-type or a low-pressure mercury lamp is also usable. Although the adhesion between the support and the layer to be adhered thereto is improved as the quantity of light for the process is increased, problems are caused that the support is colored and becomes brittle as the quantity of the light is increased. Thus, for ordinary plastic films such as polyester or polyolefin films, it is preferred to use the high-pressure mercury lamp having the main wave length of 365 nm and the quantity of the irradiation light of 20 to 10,000 ($mJ/cm^2$ ), desirably 50 to 2,000 ($mJ/cm^2$). when the low-pressure mercury lamp having the main wave length of 254 nm is used, the quantity of the irradiation light is preferably 100 to 10,000 ($mJ/cm^2$), more preferably 300 to 1,500 ($mJ/cm^2$).

Then the description will be made on the corona discharge treatment. This treatment can be conducted by any of known methods such as those described in J. P. KOKOKU Nos. Sho 48-5043 and 47-51905, and J. P. KOKAI Nos. Sho 47-28067, 49-83767, 51-41770 and 51-131576. The discharge frequency is 50 to 5,000 KHZ, preferably 5 to several hundred KHz, more preferably 10 to 30 KHz. When the discharge frequency is much too low, the stable discharge is impossible and pin holes are formed in the substance to be treated unfavorably. On the contrary, when the discharge frequency is much too high, a special device for the impedance matching is necessitated to increase the cost of the apparatus unfavorably. The processing strengt is usually 0.001 to 5 KV ·A·min/$m^2$, preferably 0.01 to 1 KV·A·min/$m^2$ The gap clearance between the electrode and the dielectrl roll is 0.5 to 2.5 mm, preferably 1.0 to 2.0 mm. In the corona discharge treatment, 6 KVA model of a solid state corona treatment machine manufactured by Pillar is usable.

In the flame treatment, a natural gas, liquefied propane gas or the like is usable. The mixing ratio of the gas to air is important The preferred mixing volume ratio of gas/air is 1/14 to 1/22, preferably 1/16 to 1/19, when the gas is propane, and is 1/6 to 1/10, preferably 1/7 to 1/9, when the gas is the natural gas.

The quantity of the flame used in the treatment is 1 to 50 Kcal/$m^2$ preferably 3 to 20 Kcal/$m^2$. The distance between the top of the inner flame of the burner and the support is shorter than 4 cm to obtain a more excellent effect. A flame treatment machine manufactured by Kasuga Electric Works Ltd. is usable for the treatment. The back up roller for supporting the support in the course of the treatment is preferably hollow so that a cooling liquid is passed through it to make the temperature constant.

The glow discharge treatment which is an effective method for the surface treatment can be conducted by any of known methods such as those described in J. P. KOKOKU Nos. Sho 35-7578, 36-10336, 45-22004, 45-22005, 45-24040 and 46-43480, U.S. Pat. Nos. 3,057,792, 3,057,795, 3,179,482, 3,288,638, 3,309,299, 3,424,735, 3,462,335, 3,475,307 and 3,761,299, British Patent No. 997,093 and J. P. KOKAI No. Sho 53-129,262.

It has been found that the glow discharge treatment is particularly effective for satisfying all the requirements of the particularly preferred polyester support having a Tg of 90 to 200° C. in the present invention, i.e. impartation of adhesion, inhibition of yellowing and prevention of blocking. Although the glow discharge treatment can be conducted in an atmosphere of oxygen, nitrogen, helium or argon while such a gas is being introduced, the introduction of such a specified gas is unsuitable for the production of the polyester support on an industrial scale in the present invention, since no remarkable effect of improving the adhesion is obtained and the gas is expensive. On the contrary, when steam is introduced, the adhesion effect is equivalent or even superior to that obtained by the introduction of the specified gas, and the cost is remarkably reduced. Thus, the process of the present invention is industrially excellent.

In the glow discharge treatment conducted in the presence of s team in the present invention, the partial pressure of steam is preferably 10 to 100%, more preferably 40 to 90% When it is below 10%, it is difficult to obtain the sufficient adhesion. The gas other than steam is air comprising nitrogen, oxygen and other components.

The steam can be quantitatively introduced into the atmosphere of the glow discharge treatment by introducing the gas from a sampling tube fitted to the glow discharge treatment apparatus into a tetrapole type mass spectrograph (MSQ-150; a product of Nippon Shinku). This treatment is conducted while t he composition is quantitatively examined.

It has been found that when the vacuum glow discharge treatment is conducted after preheating the film to be surface-treated, the adhesion is improved in a treatment time shorter than that necessitated for the treatment conducted at ambient temperature and further, the yellowing can be remarkably reduced. The term "preheating" in this step is different from a heat treatment conducted for inhibiting the curling as described below.

The preheating temperature is preferably 50° C. to Tg, more preferably 70° C. to Tg and most preferably 90° C. to Tg. When the preheating temperature is above Tg, the adhesion is slightly reduced.

The temperature of the polymer surface is elevated in vacuo by, for example, heating with an infrared heater or by bringing the surface into contact with a hot roll. For example, when the film surface is to be preheated to 115° C., it is enough that the film is brought into contact with the hot roll having a temperature of 115° C. for only 1 second or shorter. The heating method is not limited to that described above and various known heating methods can be employed.

In the glow discharge treatment of the support preheated as described above, important treatment conditions include degree of vacuum, interelectrode voltage, discharge frequency, etc. in addition to the above-described partial pressure of steam and preheating temperature of the support. By controlling these treatment conditions, the glow discharge treatment can be conducted to improve the adhesion and to inhibit the yellowing.

The pressure in the glow discharge treatment is preferably 0.005 to 20 Torr, more preferably 0.02 to 2 Torr. When the pressrue is too low, the surface of the support cannot be sufficiently modified and, therefore, the sufficient adhesion cannot be obtained. On the contrary, when the pressure is too high, the stable discharge is impossible.

The voltage is preferably in the range of 500 to 5,000 V, more preferably 500 to 3,000 V. When the voltage is too low, the surface of the support cannot be sufficiently modified and, therefore, the sufficient adhesion cannot be obtained. On the contrary, when the voltage is too high, the surface is modifed and the adhesion is reduced.

The discharge frequency used is in the range of direct current to several thousand MHz as in the prior art, preferably 50 Hz to 20 MHz and more preferably 1 KHz to 1 MHz.

The discharge processing strength is preferably 0.01 to 5 KV·A ·min/m$^2$, more preferably 0.15 to 1 KV·A·min/m$^2$ to obtain the desired adhesive properties.

After the glow discharge treatment thus conducted, it is preferred to immediately cool the support with a cooling roll. In particular, as the temperature is elevated, the plastic deformation of the support by an external force becomes easy to impair the flatness of the treated support. Further, it is possible to deposit low-molecular substances (monomers, oligomers, etc.) on the surface of the support to reduce the transparency and blocking resistance.

The description will be made on the subbing methods (2). These methods have been studied well. In the first subbing layer in the superposition method, the characteristic properties of copolymers prepared from monomers selected from among vinyl chloride, vinylidene chloride, butadiene, methacrylic acid, acrylic acid, itaconic acid, maleic anhydride, etc. and also various polymers such as polyethyleneimine, epoxy resin, grafted gelatin and nitrocellulose were studied. In the second subbing layer, the characteristic properties of mainly gelatin were studied.

In the single-layer method, the support is swollen and mixed with the hydrophilic subbing polymer by interfacial mixing method to attain the high adhesion in many cases.

Examples of the hydrophilic subbing polymers usable in the present invention include water-soluble polymers, cellulose esters, latex polymers and water-soluble polyesters. The water-soluble polymers include, for example, gelatin, gelatin derivatives, casein, agar, sodium alginate, starch, polyvinyl alcohol, polyacrylic acid copolymers and maleic anhydride copolymers. The cellulose esters include, for example, carboxymethylcellulose and hydroxyethylcellulose. The latex polyers include, for example, vinyl chloride-containing copolymers, vinylidene chloride-containing copolymers, acrylic ester-containing copolymers, vinyl acetate-containing copolymers and butadiene-containing copolymers. Among them, gelatin is the most preferred.

The compounds used in the present invention for swelling the support include, for example, resorcinol, chlororesorcinol, methylresorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Among them, resorcinol and p-chlorophenol are preferred.

Various hardeners for gelatin can be incorporated into the subbing layers in the present invention.

Examples of the hardeners for gelatin include chromium salts (such as chromium alum), aldehydes (such as formaldehyde and glutaraldehyde), isocyanates, active halogen compounds (such as 2,4-dichloro-6-hydroxy-S-triazine) and epichlorohydrin resins.

The subbing layers of the present invention can contain fine particles of inorganic substances such as $SiO_2$ and $TiO_2$ or fine particles (1 to 10 $\mu$m) of polymethyl methacrylate copolymers as the matting agent.

The subbing solution can contain various other additives, if necessary. The additives are, for example, surfactants, antistatic agents, antihalation agents, coloring dyes, pigments, coating aids and antifoggants. When the subbing solution for forming the first subbing layer is used in the present invention, it is unnecessary at all to incorporate an etching agent such as resorcinol, chloral hydrate or chlorophenol into the solutions. However, the etching agent may be incorporated into the subbing layer, if desired.

The subbing solution used in the present invention can be applied by a well known coating method such as dip coating method, air knife coating method, curtain coating method, roller coating method, wire bar coating method, gravure coating method or extrusion coating method wherein a hopper described in U.S. Pat. No. 2,681,294 is used. If necessary, two or more layers can be formed at the same time by a method described in U.S. Pat. No. 2,761,791, 3,508,947, 2,941,898 or 3,526,528 or Yuji Harasaki "Coating Kogaku (Coating Engineering)" p, 253 (published by Asakura Shoten in 1973).

The preferred support in the present invention is that having a thickness of 85 to 105 μm and prepared by heat-treating a polyethylene 2,6-naphthalene dicarboxylate at a temperature in the range of 100 to 115° C. for 24 hours and treating the surface by ultraviolet irradiation or by glow discharge, the support being characterized in that the photo-insensitive hydrophilic layer on the back side is a gelatin layer having a thickness of 1 to 7 μm and that the photo-insensitive hydrophilic layer comprises a cellulose binder having a thickness of 0.5 to 5 μm. The weight ratio of the gelatin in the photo-insensitive hydrophilic layer on the back side to that in the emulsion layer on the opposite side is preferably 0.1 to 0.5.

The detailed description will be made on the processing method of the present invention.

The color developer used for the developing process for the photosensitive material in the present invention is preferably an alkaline aqueous solution containing an aromatic primary amine color developing agent as the main ingredient. Although aminophenol compounds are usable as the color developing agent, p-phenylenediamine compounds are preferred. Typical examples of them include 3-methyl-4-amino-N,N-diethylaniline, 3-methyl-4-amino-N-ethyl-N-β-hydroxyethylaniline, 3-methyl-4-amino-N-ethyl-N-β-methane-sulfonamidoethylaniline, 3-methyl-4-amino-N-ethyl-β-methoxy-ethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl) aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl) aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl) aniline, 4-amino-3-ethoxy-N,N-bis(5-hydroxypentyl)aniline, 4-amino-3-propyl-N-(4-hydroxybutyl)aniline, and sulfates, hydrochlorides and p-toluenesulfonates of them. Among them, particularly preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline and hydrochlorides, p-toluenesulfonates and sulfates of them. These compounds are usable either singly or in combination of two or more of them depending on the purpose.

The amount of the aromatic primary amine used as the developing agent is preferably 0.0002 to 0.2 mol, more preferably 0.001 to 0.1 mol, per liter of the color developer.

The color developer may contain preservatives such as hydroxylamine; diethylhydroxylamine, hydroxylamines represented by formula (I) given in J. P. KOKAI No. Hei 3-144446, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; dye-forming couplers; competing couplers; auxiliary developing agents such as l-phenyl-3-pyrazolidone; thickening agents; and chelating agents typified by aminopolycarboxylic acids, aminopolyphosphonic acids, alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, l-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of them.

The substituted hydroxylamines are the most preferred in the above-described preservatives. Among them, diethylhydroxylamine, monomethylhydroxylamine and those having an alkyl group substituted with a water-soluble group such as sulfo group, carboxyl group or hydroxyl group are preferred. The most preferred preservatives include, for example, N,N-bis(2-sulfoethyl)hydroxylamine, monomethylhydroxylamine and diethylhydroxylamine.

The color developer used in the present invention can contain an antifoggant, if necessary. The antifoggants include alkali metal halides such as sodium chloride, potassium bromide and potassium iodide, and organic antifoggants. The organic antifoggants are typified by nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The preferred pH range of the color developer used in the present invention is about 9.5 to 10.5. To prevent the ammonia gas formation from the waste solution, pH of the mother developer is preferably as low as possible so far as the developing activity can be kept. The most preferred pH of the mother developer is about 9.9 to 10.4.

To keep the pH in the above-described range, a buffering agent is preferably used. The buffering agents include, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. The carbonates are particularly preferred.

The amount of the buffer to be added to the developer is preferably at least 0.1 mol/l, particularly in the range of 0.1 mol/l to 0.04 mol/l.

The chelating agents are preferably biodegradable compounds such as those described in J. P. KOKAI Nos. Sho 63-146998, 63-199295, 63-267750 and 63-267751, J. P. KOKAI Nos. Hei 2-229146 and 3-186841, German Patent No. 3,739,610 and European Patent No. 468325.

The processing solutions in the color developer-replenishing tank and processing tank are preferably sealded with a liquid such as a high-boiling organic solvent to reduce the area to be brought into contact with air. The most preferred sealding liquid is liquid paraffin. It is particularly preferably used for the replenisher.

The processing temperature with the color developer in the present invention is 30 to 55° C., preferably 35 to 55° C.

The processing time ranges from 20 seconds to 5 minutes, preferably from 30 seconds to 3 minutes 20 seconds.

The amount of the replenisher is about 30 to 800 ml, preferably 50 to 500 ml, per square meter of the photosensitive material.

When the reversal process is employed, the color development is conducted usually after the black-and-white development. The black-and-white developer contains a known black-and-white developing agent including a dihydroxybenzene such as hydroquinone, a 3-pyrazolidone such as 1-phenyl-3-pyrazolidone or an aminophenol such as N-methyl-p-aminophenol either singly or in combination of them.

A development accelerator can be added, if necessary, to the developer used in the present invention.

The development accelerators, usable if necessary, include thioether compounds described in J. P. KOKOKU Nos. Sho 37-16088, 37-5987, 38-7826, 44-12380 and 45-9019 and U.S. Pat. No. 3,813,247; p-phenylenediamine compounds described in J. P. KOKAI Nos. Sho 52-49829 and 50-15554; quaternary ammonium salts described in J. P. KOKAI No. sho 50-137726, J. P. KOKOKU No. Sho 44-30074 and J. P. KOKAI Nos. Sho 56-156826 and 52-43429; amine compounds described in U.S. Pat. Nos. 2,494,903, 3,128,182, 4,230,796 and 3,253,919, J. P. KOKOKU No. Sho 41-11431 and U.S. Pat. Nos. 2,482,546, 2,596,926 and 3,582,346; polyalkylene oxides described in J. P. KOKOKU Nos. Sho 37-16088 and 42-25201, U.S. Pat. No. 3,128,183, J. P. KOKOKU Nos. Sho 41-11431 and 42-23883 and U.S. Pat. No. 3,532,501; and l-phenyl-3-pyrazolidones and imidazoles.

The detailed description will be made on the desilverization steps in the present invention.

The desilverization steps usually comprise a bleaching step, bleach-fixing step and fixing step. Specific examples of the steps are given below, which by no means limit the steps:

(step 1) bleach-fixing (step 2) bleaching/bleach-fixing (step 3) bleaching/bleach-fixing/fixing (step 4) fixing/bleach-fixing (step 5) bleaching/fixing In the present invention, the steps 1, 2, 3 and 4 wherein a bleach-fixing solution is used are preferred. Particularly when the bleach-fixing solution is employed in the present invention, the deterioration in reading the magnetic records is effectively inhibited.

The bleaching agents used for preparing the processing solution having the bleaching effect include ferric aminopolycarboxylate complexes, persulfates, bromates, hydrogen peroxide, potassium ferricyanide, etc. In them, the ferric aminopolycarboxylate complexes are the most preferred.

The ferric complex salt to be added to the solution and thereby dissolved therein in the present invention may be in the form of the previously formed ferric complex salt or, alternatively, the complex salt may be formed from a complex-forming compound and a ferric salt (such as ferric sulfate, ferric chloride, ferric bromide, ferric nitrate or ferric ammonium sulfate) in the solution having the bleaching effect.

The complex-forming compound may be used in an amount slightly larger than that necessitated for forming the complex with ferrc ion. In such a case, it is usually used in an amount larger than the necessitated amount by 0.01 to 10%.

The compounds capable of forming the ferric complex salt in the solution having the bleaching effect in the present invention include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, α-methylnitrilotriacetic acid, 1,4-diaminobutanetetraacetic acid, glycol ether diaminetetraacetic acid, N-(2-carboxyphenyl)iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid. The compounds are not limited to those listed above.

The concentration of the ferric complex salt in the processing solution having the bleaching effect in the present invention is in the range of 0.005 to 1.0 mol/l, preferably 0.01 to 0.50 mol/l and more preferably 0.02 to 0.30 mol/l.

The concentration of the ferric complex salt in the replenisher for the processing solution having the bleaching effect is preferably 0.005 to 2 mol/l, more preferably 0.01 to 1.0 mol/l.

The baths having the bleaching effect or pre-processing baths can contain a bleaching accelerator selected from among various compounds. Preferred are, for example, compounds having a mercapto group or disulfide bond described in U.S. Pat. No. 3,893,858, German Patent No. 1,290,812, J. P. KOKAI No. Sho 53-95630 and Research Disclosure No. 17129 (July, 1978); thiourea compounds described in J. P. KOKOKU No. Sho 45-8506, J. P. KOKAI Nos. Sho 52-20832 and 53-32735 and U.S. Pat. No. 3,706,561; and halides such as iodides and bromides, since they have a high bleaching power.

The baths having the bleaching effect and usable in the present invention can contain a rehalogenating agent such as a bromide (e. g. potassium, sodium or ammonium bromide), chloride (e. g. potassium, sodium or ammonium chloride) or iodide (e. g. ammonium iodide). If necessary, one or more inorganic and organic acids and alkali metal or ammonium salts of them having a pH-buffering effect can be added to the solution. They include, for example, borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid. Further, an anticorrosive agent such as ammonium nitrate or guanidine may be added to the solution.

The bath having the bleaching effect can contain a fluorescent brightener, antifoaming agent, surfactant or organic solvent such as polyvinylpyrrolidone or methanol.

As the fixing agent in the bleach-fixing solution or fixing solution, the above-described thiosulfates and compounds of the formula (I) are usable. The thiosulfates include sodium thiosulfate, potassium thiosulfate, ammonium thiosulfate, etc. Further, known fixing agents; thiocyanates such as sodium thiocyanate and ammonium thiocyanate; thioether compounds such as ethylene bisthioglycolic acid and 3,6-dithia-1,8-octanediol; and water-soluble silver halide solubilizers such as thioureas are also usable. In the present invention, the thiosulfates, particularly ammonium thiosulfate and sodium thiosulfate, are preferably used. The total amount of the fixing agent is preferably 0.3 to 3 mol/l, more preferably 0.5 to 2.0 mol/l.

The processing solution of the present invention having the fixing effect preferably contains a compound of the following formula (II) in order to improve the accuracy in reading the magnetic record:

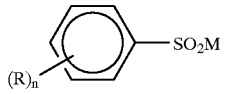

In the above formula, R represents a substituent of the benzene ring, n represents an integer of 0 to 6, and when n is 2 or larger, R's may be the same or different from each other. Preferred substituents include, for example, alkyl groups having 1 to 3 carbon atoms, substituted alkyl groups having 1 to 3 carbon atoms, alkoxy groups having 1 to 3 carbon atoms, hydroxyl group, nitro group, carboxylic acid groups, sulfonic acid groups, halogen atoms and phosphonic acid groups. Preferred substituents of the alkyl groups are hydroxyl group, carboxylic acid group and sulfonic acid groups. M represents a hydrogen atom, alkali metal, alkaline earth metal, ammonium or amine.

Examples of the preferred compounds are given below, which by no means limit these compounds.

(II-1)

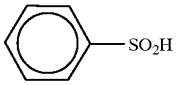

(II-2)

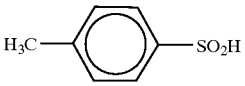

(II-3)

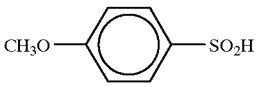

(II-4)

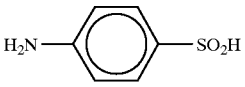

(II-5)

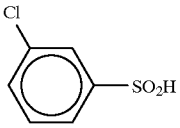

(II-6)

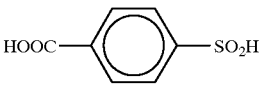

(II-7)

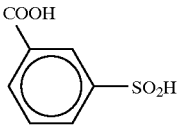

(II-8)

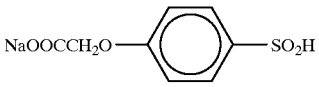

(II-9)

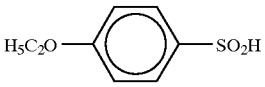

(II-10)

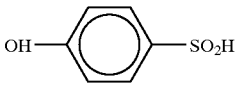

-continued (II-11)

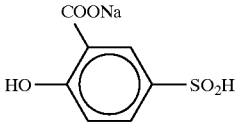

(II-12)

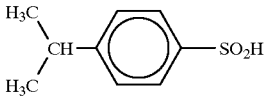

(II-13)

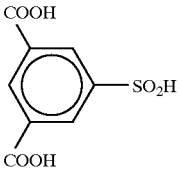

(II-14)

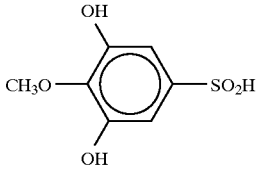

(II-15)

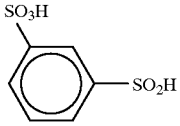

(II-16)

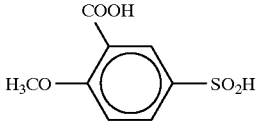

(II-17)

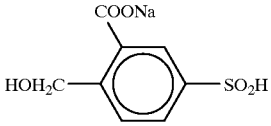

(II-18)

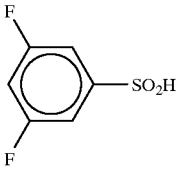

(II-19)

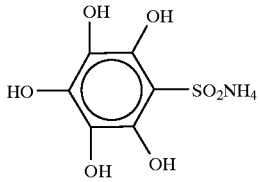

(II-20)

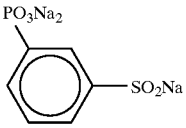

(II-21)

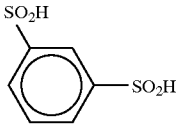

(II-22)

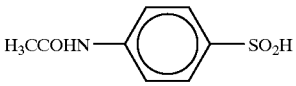

-continued

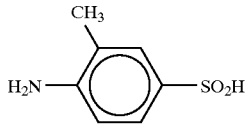

(II-23)

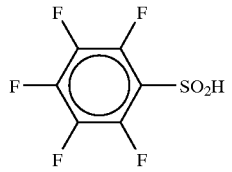

(II-24)

Such a compound as that described above is used in an amount of 0.01 to 2 mols, preferably 0.5 to 1 mol, per liter of the processing solution.

The bleach-fixing solution or fixing solution of the present invention desirably contains a sulfite (or bisulfite or metabisulfite) as the preservative. The amount of such a compound is preferably 0.3 to 0.5 mol/l, more preferably 0.05 to 0.3 mol/l.

The bleach-fixing solution or fixing solution of the present invention contains the above-described preservative selected from among sulfite ion-releasing compounds, for example, sulfites (such as sodium, potassium and ammonium sulfites), hydrogensulfites (such as ammonium, sodium and potassium hydrogensulfites) and metabisulfites (such as potassium, sodium and ammonium metabisulfites) and, if necessary, an aldehyde (such as benzaldehyde or acetaldehyde), ketone (such as acetone), ascorbic acid compound, hydroxylamine, benzenesulfinic acid, alkylsulfinic acid and the like.

If necessary, the bleaching solution, bleach-fixing solution and fixing solution may contain a buffering agent, fluorescent brightener, chelating agent, anti-foaming agent, mildew-proofing agent and so on.

The pH range of the bleaching solution or bleach-fixing solution used in the present invention is preferably 4 to 8, more preferably 4.5 to 6.5.

The quantity of the replenisher for the bleaching solution, bleach-fixing solution or fixing solution used in the present invention is 50 to 2,000 ml per $m^2$ of the photosensitive material. The particularly remarkable effect of the present invention can be obtained when the amount of the replenisher having the fixing effect is 100 to 550 ml. If necessary, the overflowing water used for washing or overflowing stabilizing bath which is a subsequent bath can be used as the replenisher.

The processing temperature with the bleaching solution, bleach-fixing solution or fixing solution is 20 to 50° C., preferably 30 to 45° C. The processing time is 10 seconds to 3 minutes, preferably 20 seconds to 2 minutes.

In the processing with the processing solution having the bleaching effect, it is particularly preferred to conduct aeration so as to keep the photographic properties very stable in the present invention. The aeration con be conducted by a method known in the art, such as blowing of air into the processing solution having the bleaching effect or absorption of air with an ejector.

In the blowing of air, it is preferred to release air into the solution by means of a diffusing tube having fine pores. Such a type of diffusing tube is widely used in, for example, an aeration tank in the treatment of an activated sludge. In the aeration, techniques described on pages BL-1 to BL-2 of Z-121, Using Process C-41 (the third edition) published by Eastman Kodak Co. in 1982 can be employed. In the process of the present invention with the processing solution having bleaching effect, vigorous stirring is preferred. For the stirring, contents of J. P. KOKAI No. Hei 3-33847 (from line 6, right upper column to line 2, left lower column on page 8) can be employed as they are.

In the desilverizing steps, the stirring is conducted preferably as vigorously as possible by, for example, a method which comprises bumping a jet of the processing solution against the emulsion surface of the photosensitive material as described in J. P. KOKAI No. Sho 62-183460; a method wherein the stirring effect is improved with a rotating means as described in J. P. KOKAI No. Sho 62-183461; a method wherein the photosensitive material is moved while the emulsion surface thereof is brought into contact with a wiper blade provided in the solution so as to make the flow on the emulsion surface turbulent and thereby improving the effect of the stirring; and a method wherein the quantity of the circulating flow of the whole processing solutions is increased. Such a means of making the stirring vigorous is effective for any of the bleaching solution, bleach-fixing solution and fixing solution. Supposedly, the improvement in the stirring effect accelerates the feeding of the bleaching agent and fixing agent into the emulsion membrane, thereby increasing the desilverizing speed. The above-described means of improving the stirring effect are more effective when a bleaching accelerator is used. In such a case, the acceleration effect is further improved and inhibition of the fixing by the bleaching accelerator can be controlled.

An automatic developing machine used for developing the photosensitive material of the present invention preferably has a means of transporting the photosensitive material as described in J. P. KOKAI Nos. Sho 60-191257, 60-191258 and 60-191259. As described in J. P. KOKAI No. Sho 60-191257, such a transportation means remarkably reduces the amount of the processing solution brought from the preceding bath into a subsequent bath, so that the deterioration in the function of the processing solution can be remarkably prevented. Such a function is particularly effective in reducing the processing time in each step and also in reducing the amount of the replenisher.

After the desilverization, the photosensitive material of the present invention is usually treated in washing step with water and/or stabilization step.

The amount of water used in the washing step varies in a wide range depending on the properties of the photosensitive material (which depend on, for example, couplers used), use thereof, temperature of water used for washing, number of the tanks used for washing with water (number of stages), replenishing method such as counter flow or down-flow system and various other conditions. Among them, the relationship between the number of the tanks for washing with water and the amount of water in the multi-stage counter flow system can be determined by a method described in "Journal of the Society of Motion Picture and Television Engineers", Vol. 64, pages 248 to 253 (May, 1955). Although the amount of water necessitated for washing can be remarkably reduced by the multi-stage counter flow method described in this literature, another problem is caused in this method that bacteria propagate themselves as the residence time of water in the tanks is prolonged and, as a result, a suspended matter thus formed is attached to the photosensitive material. For solving this problem, a very effective method for reducing the amount of calcium ion and magnesium ion described in J. P. KOKAI No. Sho 62-288, 838 can be employed. Further, this problem can be solved also by using isothiazolone compounds described in J. P. KOKAI No. Sho 57-8,542, thiabendazoles, chlorinecontaining germicides such as chlorinated sodium isocyanurates, benzotriazoles and germicides described in Hiroshi Horiguchi "Bokin Bobai-zai no Kagaku (Chemistry for Prevention of Bacteria and Fungi)" published by Sankyo Book Publishing Co. in 1986, "Biseibutsu no Mekkin, Sakkin, Bobai Gijutsu (Technique of Sterilization and Prevention of Microorganisms)" edited by Eisei Gijutsu-kai and published by Kogyo Gijutsu-kai in 1982 and "Bokinbobai-zai Jiten (Dictionary of Steriliers and Antifungal Agents)" edited by Nippon Bokinbobai Gakkai and published in 1986.

The pH of washing water used for processing the photosensitive material of the present invention is 4 to 9, preferably 5 to 8. The temperature and time which vary depending on the properties and use of the photosensitive material are usually 15 to 45° C. and 20 seconds to 10 minutes, preferably 25 to 40° C. and 30 seconds to 5 minutes. The photosensitive material in the present invention can be processed directly with a stabilizing solution in place of washing with water. The stabilization can be conducted by any of known processes described in J. P. KOKAI Nos. Sho 57- 8543, 58-14834 and 60-220345.

The stabilizing solution contains a compound which stabilizes the color image, selected from among, for example, formalin, benzaldehydes such as m-hydroxybenzaldehyde, formaldehyde/bisulfite adduct, hexamethylenetetramine and derivatives thereof, hexahydrotriazine and derivatives thereof, dimethylurea, N-methylol compounds such as N-methylolpyrazole, organic acids and pH buffering agents. The preferred amount of these compounds is 0.001 to 0.02 mol per liter of the stabilizing solution. The free formaldehyde concentration in the stabilizing solution is preferably as low as possible so as to prevent formaldehyde gas from sublimation. From such a point of view as above, preferred color image stabilizers are m-hydroxybenzaldehyde, hexamethylenetetramine, N-methylolazole compounds described in J. P. KOKAI No. Hei 4-270344 such as N-methylolpyrazole and azolylmethylamines described in J. P. KOKAI No. Hei 4-313753 such as N,N'-bis(1,2,4-triazol-1-ylmethyl)piperazine. Particularly preferred is a combination of an azole such as 1,2,4-triazole with an azolylmethylamine such as 1,4-bis(1,2,4-triazol-l-ylmethyl)piperazine or a derivative thereof as described in J. P. KOKAI No. Hei 4-359249 (corresponding to European Patent Unexamined Published Application No. 519190 A 2), since a high image stability and a low formaldehyde vapor pressure are realized by the combination. The stabilizing solution preferably contains, if necessary, an ammonium compound such as ammonium chloride or ammonium sulfite, a metal compound of Bi or Al, a fluorescent whitening agent, a hardener, an alkanolamine described in U.S. Pat. No. 4,786,583, and a preservative which can be contained in also the above-described fixing solution and bleach-fixing solution such as a sulfinic acid compound described in J. P. KOKAI No. Hei 1-231051.

Various surfactants can be incorporated into the washing water and/or stabilizing solution so as to prevent the formation of water spots in the course of drying of the processed photosensitive material. Among them, preferred is an anionic surfactant, particularly an alkylphenol/ethylene oxide adduct. The alkylphenols are particularly preferably octyl-, nonyl-, dodecyl- and dinonylphenols. The molar number of ethylene oxide to be added is particularly preferably 8 to 14. It is also preferred to use a silicon surfactant having a high antifoaming effect.

The washing water and stabilizing solution preferably contain a chelating agent. Preferred chelating agents include aminopolycarboxylic acids such as ethylenediaminetetraacetic acid and diethylene-triaminepentaacetic acid; organic phosphonic acids such as 1-hydroxyethylidene-1,1-diphosphonic acid, N,N,N'-trimethylenephosphonic acid and diethylenetriamine-N,N,N',N-tetramethylenephosphonic acid; and hydrolyzates of maleic anhydride polymers described in European Patent No. 345,172 A 1.

The overflow obtained during the washing with water and/or replenishing of the stabilizing solution is reusable in other steps such as the desilverizing step.

When each of the above-described processing solutions is concentrated by evaporation in the process with an automatic developing machine, it is preferred to replenish a suitable amount of water, correcting solution or process replenisher in order to compensate the solution for concentration caused by the evaporation. Although the method for replenishing water is not particularly limited, the following methods are preferred: a method described in J. P. KOKAI Nos. Hei 1-254959 and 1-254960 wherein a monitor water tank which is different from the bleaching tank is provided, the amount of water evaporated from the monitor water tank is determined, the amount of water evaporated from the bleaching tank is calculated from the determined amount of evaporated water, and water is replenished into the bleaching tank in proportion to the amount of evaporated water; and a method described in J. P. KOKAI Nos. Hei 3-248155, 3-249644, 3-249645 and 3-249646 wherein the compensation for the evaporation is conducted with a liquid level sensor or overflow sensor. Although water for compensating for the evaporation in each processing solution may be tap water, deionized water or sterilized water preferably used in the above-described water washing steps is preferred.

The description will be made on the photosensitive material usable in the present inventions.

Although any kind of the photosensitive materials having the above-described transmittant support can be processed by the present invention, color negative films and color reversal films are preferred.

The silver halide emulsions, other substances (such as additives), layers in the photographic structure (such as layer configuration), methods for processing the photosensitive materials, and additives used for the processing according to the present invention are pereferably those described in the specifications of the following patents, particularly European Patent No. 0,355,660 A2 (Japanese Patent Application No. Hei 1-107011):

TABLE 1

| Photographic constituent, etc.. | J.P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |

TABLE 1-continued

| Photographic constituent, etc.. | J.P. KOKAI No. Sho 62-215272 |
|---|---|
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |
| Color coupler(cyan, magenta or yellow coupler) | From line 4, right upper column, p. 91 to line 6, left upper column, p. 121 |
| Color development improver | From line 7, left lower column, p. 121 to line 1, right upper column, p. 125 |

TABLE 2

| Photographic constituent, etc. | J.P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as antistatic agent, coating assistant, lubricant, adhesion inhibitor, etc.) | Line 1, left lower column, p. 210; and line 5, left lower column, p. 222 |

TABLE 3

| Photographic constituent, etc. | J.P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |

TABLE 3-continued

| Photographic constituent, etc. | J.P. KOKAI No. Sho 62-215272 |
|---|---|
| Development inhibitor releasing compound | Lines 3 to 9, right lower column, p. 155 |
| Support | Line 19, right lower column, p. 155; and line 14, left upper column, p. 156 |
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper column, p. 240 to the last line, right upper column, p. 240 |
| Photographic process (steps and additives) | From line 7, right upper column, p. 3 to line 5, right upper column, p. 10 |

Notes)

The cited portions of J.P. KOKAI No. Sho 62-215272 includes also those amended by the Written Amendment dated March 16, 1987 as stated at the end of this patent publication.

Among the above-described couplers, preferred yellow couplers are so-called short-wave type yellow couplers described in J.P. KOKAI Nos. Sho 63-231451, Sho 63-123047, Sho 63-241547, Hei 1-173499, 1-213648 and 1-250944.

TABLE 4

| Photographic constituent, etc. | J.P. KOKAI NO. Hei 2-33144 | EP 0,355,660A2 |
|---|---|---|
| Silver halide emulsion | From line 16, right upper column, p. 28 to line 11, right lower | From line 53, p. 45 to line |

TABLE 4-continued

| Photographic constituent, etc. | J.P. KOKAI NO. Hei 2-33144 | EP 0,355,660A2 |
|---|---|---|
| | column, p. 29; and lines 2 to 5, p. 30 | 3, p. 47; and lines 20 to 22, p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, p. 3 to the last line, left upper column, p. 18; and from line 6, right upper column, p. 30 to line 11, right lower column, p. 35 | Lines 15 to 27, p. 4; from line 30, p. 5 to the last line, p. 28; lines 29 to 31, p. 45; and from line 23, p. 47 to line 50, p. 63 |
| Ultraviolet absorber | From line 14, right lower column, p. 37 to line 11, left upper column, p. 38 | Lines 22 to 31, p. 65 |
| Decoloration inhibitor (image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |
| Antistaining agent | The last line, left upper column, p. 37 and line 13, right lower column, p. 37 | From line 32, p. 65 to line 17, p. 66 |

TABLE 5

| Photographic constituent, etc. | J.P. KOKAI No. Hei 2-33144 | EP 0,355,660A2 |
|---|---|---|
| Surfactant | From line 1, right upper column, p. 18 to the last line, right lower column, p. 24; and from line 10 from below, left lower column, p. 27 to line 9, right lower column, p. 27 | |
| Fluorine-containing compound (as antistatic agent, coating assistant, lubricant, adhesion inhibitor, etc.) | Line 1, left upper column, p. 25 to line 9, right upper column, p. 27 | |
| Binder (hydrohilic colloid) | Lines 8 to 18, right upper column, p. 38 | Lines 23 to 28, p. 66 |
| Support | From line 18, right upper column, p. 38 to line 3, left upper column, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |

TABLE 5-continued

| Photographic constituent, etc. | J.P. KOKAI No. Hei 2-33144 | EP 0,355,660A2 |
|---|---|---|
| Photographic process (steps and additives | From line 4, left upper column, p. 39 to the last line, left upper column, p. 42 | From line 14, p. 67 to line 28, p. 69 |

Silver halide emulsions having various halogen compositions such as silver bromoiodide, silver chloroiodide, silver chlorobromoiodide, silver chlorobromide, silver bromide and silver chloride can be used in the present invention. In the present invention, the photosensitive material preferably has a layer containing a silver bromoiodide emulsion having an iodine content of preferably about 1.0 to 10 molar %. Although the amount of silver to be used for preparing the photosensitive material is not particularly limited, it is preferably about 2 to 8 g/m$^2$, more preferably about 3 to 6 g/m$^2$. When the amount of silver is below this range, the quality of the image is deteriorated unfavorably and, on the contrary, when it exceeds the range, the accuracy in reading the magnetic record is reduced unfavorably.

The photosensitve material used in the present invention can contain various couplers. The details of them are given in Table 2.

Preferred cyan couplers include diphenylimidazole cyan couplers described in J. P. KOKAI No. Hei 2-33144, as well as 3-hydroxypyridine cyan couplers described in European Patent No. 0,333,185 A2 [particularly preferred are a cyan coupler prepared by converting a tetraequivalent coupler (42) into a diequivalent one by introducing a chlorine-linked cupling-off group, and couplers (6) and (9) mentioned therein], and cyclic active methylene cyan cuplers described in J. P. KOKAI No. Sho 64-32260 (particularly preferred are Couplers 3, 8 and 34 mentioned therein).

A dye (particularly an oxonol dye) which can be decolored by a process as described on pages 27 through 76 of European Patent No. 0,337,490 A2 can be incorporated into the hydrophilic colloid layer in such a manner that the optical reflection density of the photosensitive material will be 0.70 or above at 680 nm in order to improve the sharpness of the image.

The photosensitive material for color photography of the present invention preferably contains a compound for improving the color image preservation as described in European Patent No. 0,277,589 A2 in combination with the coupler. The combination with a pyrazoloazole coupler is particularly preferred.

To inhibit the staining caused by a dye formed by, for example, the reaction of the color developing agent or an oxidation product thereof remaining in the membrane with the coupler and other side effects during the storage after the process, it is preferred to use a compound (F) which can be chemically bonded with an aromatic amine developing agent remaining after the color development to form a chemically inert, substantially colorless compound and/or a compound (G) which can be chemically bonded with an oxidation product of the aromatic amine developing agent remaining after the color development to form a chemically inert, substantially colorless compound.

A mildew-proofing agent as describedin J. P. KOKAI No. sho 63-271247 is preferably incorporated into the photosensitive material of the present invention in order to prevent the propagation of fungi and bacteria in the hydrophilic colloid layer, since they deteriorate the image.

To reduce the quantity of the carryover and to increase the silver recovery, the dry film thickness of the silver halide photosensitive material of the present invention for color photography excluding the support is preferably 25, m or below, more preferably about 13 to 23 $\mu$m and most preferably about 9 to 19 $\mu$m.

The thickness of the film can be reduced by reducing the amount of gelatin, silver, oil, coupler, etc. The reduction of the amount of gelatin is most preferred. The film thickness can be determined by an ordinary method after leaving the sameple to stand at 25° C. at 60 RH % for two weeks.

To improve the prevention from stain and image preservation, the degree of swelling of the photographic layers of the silver halide photosensitive material for color photography used in the invention is preferably 1.5 to 4.0, particularly 1.5 to 3.0. The term "degree of swelling" herein indicates a value obtained by dividing the thickness of the photographic layers after immersing the color photosensitive material in distilled water of 33° C. for 2 minutes by the thickness of the dry photographic layers.

The term "photographic layers" indicates layers composed of at least one photosensitive silver halide emulsion layer laminated with hydrophilic colloid layers, the former layer and the latter layers being water-permeable between each other. The photographic layers do not include a back layer provided on the support on an opposite side to the photographic photosensitive layers. The photographic layers comprise usually two or more layers participating in the formation of a photographic image, namely, a silver halide emulsion layer, intermediate layer, filter layer, antihalation layer and protecting layer.

The degree of swelling can be controlled as described above by any method. For example, it can be controlled by varying the amount and kind of the gelatin and those of the hardener used for the photographic film or by varying the drying conditions and leaving-to-stand conditions after forming the photographic layers. Although gelatin is advantageously used for forming the photographic layers, other hydrophilic colloids are also usable. For example, various hydrophilic macromolecular substances can be used such as gelatin derivatives; graft polymers of gelatn and another polymer; proteins such as albumin and casein; cellulose derivatives such as hydroxy-ethylcellulose, carboxymethylcellulose and cellulose sulfate; saccharide derivatives such as sodium alginate and starch derivatives; and synthetic hydrophilic macromolecular substances such as homopolymers or copolymers, e. g. polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include gelatin treated with lime or an acid, gelatin hydrolyzate and enzymatic decomposition products of gelatin. The gelatin derivatives are obtained by reacting gelatin with a compound selected from among various acid halides, acid anhydrides, isocyanates, bromoacetic acid, alkanesultones, vinylsulfonamides, maleinimide compounds, polyalkylene oxides and epoxy compounds.

The graft polymers of gelatin usable herein include those obtained by grafting a homopolymer or copolymer of a vinyl monomer such as acrylic acid, methacrylic acid or a derivative thereof, e.g. an ester or amide thereof, acrylonitrile or styrene onto gelatin. Preferred are graft polymers of gelatin with a polymer which is compatible with gelatin to some extent such as a polymer of acrylic acid, methacrylic acid, acrylamide, methacrylamide or hydroxyalkyl methacrylate. Examples of them are given in U.S. Pat. Nos. 2,763,625, 831,767, 2,956,884 and so on. Typical synthetic hydrophilic macromolecular substances are described in, for example, West German Patent Application (OLS) No. 2,312,708, U.S. Pat. Nos. 3,620,751 and 3,879,205 and-J. P. KOKOKU No. Sho 43-7561.

The hardening agents include, for example, chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds {such as 1,3,5-triacryloyl-hexahydro-s-triazine, bis(vinylsulfonyl) methyl ether and N,N'-methylenebis-[β-(vinylsulfonyl) propionamide]}, active halogen compounds (such as 2,4-dichloro-6-hydroxy-s-triazine), mucohalogenic acids (such as mucochloric acid and mucophenoxychloric acid), isoxazoles, dialdehyde starch and 2-chloro-6-hydroxytriazinylated gelatin. They can be used either singly or in combination of them.

Preferred hardening agents are the aldehydes, active vinyl compounds and active halogen compounds.

The photosensitive material of the present invention may be exposed to a visible light or infrared light. The exposing method may be either a low illuminance exposure or a high-illuminance short-time exposure. In the latter, a laser scanning exposing method wherein the exposure time per picture element is shorter than $10^{-4}$ second is preferred.

In the exposure, a band stop filter described in U.S. Pat. No. 4,880,726 is preferably used in order to remarkably improve the color reproducibility by avoiding the optical color mixing.

The processing method of the present invention can be employed for various photosensitive materials, in particular, color negative films, color reversal films, negative films for movies and positive films for movies Among them, the color negative films are preferred.

The following Examples will further illustrate the present invention, which by no means limit the invention.

EXAMPLE 1

(1) Materials for the support:

The supports used in the Examples were prepared by the following methods:

PEN: 100 parts by weight of commercially available poly(ethylene-2,6-naphthalate) which is a polymer corresponding to P-1 given in this specification and 2 parts by weight of Tinuvin P. 326 (a product of Geigy) were dried by an ordinary method and then molten at 300° C. The melt was extruded through a T-shaped die and the product was longitudinally stretched to 3.3-fold length at 140° C. and then transversely stretched to 3.3-fold at 130° C. The product was set by heat at 250° C. for 6 seconds. The glass transition temperature of the product was 120° C.

TAC: Triacetylcellulose was produced by 15% band method, i.e., an ordinary solution casting method under the conditions comprising a methylene chloride/methanol weight ratio of 82/8, TAC concentration of 13% and plasticizer TPP/BDP of 2/1 (TPP being triphenyl phosphate and BDP being biphenyl diphenyl phosphate).

(2) Formation of subbing layer:

Both surfaces of each of the above-described supports were processed by corona discharge treatment. Then a subbing solution having a composition given below was applied to the surface to form the subbing layer on one side to be exposed to a high temperature in the stretching step. The corona discharge treatment was conducted with a 6 KVA model of a solid state corona treatment machinie manufactured by Pillar. The support having a width of 30 cm was dtreated at a rate of 20 m/min. From the readings of the electric current and voltage, it was found that the processing strength was 0.375 KV·A·min/$m^2$, The discharge frequency in the process was 9.6 KHz, and the gap clearance between the electrode and the dielectric roll was 1.6 mm.

Gelatin 3 g

Distilled water 250 ml

Sodium α-sulfodi-2-ethylhexyl succinate 0.05 g

Formaldehyde 0.02 g

A subbing layer having the following composition was formed on the support TAC.

Gelatin 0.2 g

Salicylic acid 0.1 g

Methanol 15 ml

Acetone 85 ml

Formaldehyde 0.01 g (3) Formation of back layers:

The first back layer to the third back layer as will be described below were formed by coating one side of the subbed support prepared in the above-described step (2):

A) The first back layer:

Fine powder of Co-containing needle-shaped γ-iron oxide (in the form of dispersion in gelatin; average particle diameter: 0.08 μm) 0.2 g/$m^2$ Gelatin 3 g/$m^2$ Compound of formula 21 given below 0.1 g/$m^2$ Compound of formula 22 given below 0.02 g/$m^2$

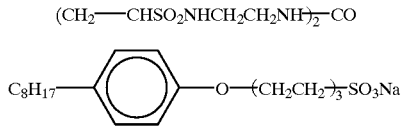

B) The second back layer:

Gelatin 0.5 g/$m^2$

Conductive material [$SnO_2/Sb_2O_{03}$ (9:1), particle diameter: 15 μm) 0.16 g/$m^2$ Sodium dodecylbenzenesulfonate 0.5 g/$m^2$ C) The third back layer:

Gelatin 0.5 g/m$^2$

Polymethyl methacrylate (average particle diameter: 1.5 $\mu$m) 0.02 g/m$^2$

Cetyl stearate (dispersed in sodium dodecylbenzenesulfonate) 0.01 g/m$^2$

Sodium di(2-ethylhexyl)sulfosuccinate 0.01 g/m$^2$

Compound of formula 23 given below 0.01 g/m$^2$

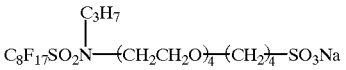

The back layers thus obtained had a coercive force of 960 Oe.

(4) Heat treatment of support:

After the formation of the subbing layer and back layers on the support followed by drying and rolling, the product was heat-treated at 110° C. for 48 hours.

A photosensitive layer shown in the following step (5) was formed on the two kinds of supports prepared as described above to obtain the photosensitive material. The photosensitive material having the PEN support will be referred to as "Sample 101" and that having the TAC support will be "Sample 102". A sample having the PEN support and not subjected to the heat treatment (4) will be referred to as "Sample 103".

(5) Production of photosensitive layers:

The main materials used for forming the layers are as follows:

ExC: cyan coupler,

ExM: magenta coupler,

ExY: yellow coupler,

ExS: sensitized dye,

UV: ultraviolet absorber,

HBS: high boiling organic solvent, and

H: gelatin hardener.

The numerals for the respective components indicate the amounts (g/m$^2$) of the coatings, and those for silver halides are given in terms of silver. The amount of the sensitizing dye is given in terms of mol per mol of the silver halide contained in the same layer.

| The first layer (antihalation layer) | | |
|---|---|---|
| Black colloidal silver | silver | 0.09 |
| Gelatin | | 1.60 |
| ExM-1 | | 0.12 |
| ExF-1 | | $2.0 \times 10^{-3}$ |
| Solid dispersed dye ExF-2 | | 0.030 |
| Solid dispersed dye ExF-3 | | 0.040 |
| HBS-1 | | 0.15 |
| HBS-2 | | 0.02 |
| **The second layer (intermediate layer)** | | |
| Silver bromoiodide emulsion M | silver | 0.065 |
| ExC-2 | | 0.04 |
| Polyethyl acrylate latex | | 0.20 |
| Gelatin | | 1.04 |
| **The third layer (slow-speed red-sensitive emulsion layer)** | | |
| Silver bromoiodide emulsion A | silver | 0.25 |
| Silver bromoiodide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |

-continued

| | | |
|---|---|---|
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| **The fourth layer (medium-speed red-sensitive emulsion layer)** | | |
| Silver bromoiodide emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| **The fifth layer (high-speed red-sensitive emulsion layer)** | | |
| Silver bromoiodide emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| **The sixth layer (intermediate layer)** | | |
| Cpd-1 | | 0.090 |
| Solid dispersed dye ExF-4 | | 0.030 |
| HBS-1 | | 0.050 |
| Polyethyl acrylate latex | | 0.15 |
| Gelatin | | 1.10 |
| **The seventh layer (low-speed green-sensitive emulsion layer)** | | |
| Silver bromoiodide emulsion E | silver | 0.15 |
| Silver bromoiodide emulsion F | silver | 0.10 |
| Silver bromoiodide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| **The eighth layer (medium-speed green-sensitive emulsion layer)** | | |
| Silver bromoiodide emulsion H | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| **The ninth layer (high-speed green-sensitive emulsion layer)** | | |
| Silver bromoiodide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |

-continued

| | | |
|---|---|---|
| ExM-4 | | 0.025 |
| ExM-5 | | 0.040 |
| Cpd-3 | | 0.040 |
| HBS-1 | | 0.25 |
| Polyethyl acrylate latex | | 0.15 |
| Gelatin | | 1.33 |
| The tenth layer (yellow filter layer) | | |
| Yellow colloidal silver | silver | 0.015 |
| Cpd-1 | | 0.16 |
| Solid dispersed dye ExF-5 | | 0.060 |
| Solid dispersed dye ExF-6 | | 0.060 |
| Oil-soluble dye ExF-7 | | 0.010 |
| HBS-1 | | 0.60 |
| Gelatin | | 0.60 |
| The eleventh layer (low-speed blue-sensitive emulsion layer) | | |
| Silver bromoiodide emulsion J | silver | 0.09 |
| Silver bromoiodide emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| The twelfth layer (high-speed blue-sensitive emulsion layer) | | |
| Silver bromoiodide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| The thirteenth layer (the first protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| The fourteenth layer (the second protective layer) | | |
| Silver bromoiodide emulsion M | silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| Gelatin | | 0.70 |

These layers suitably contain W-1 to W-3, B-4 to B-6,, F-1 to F-17, iron salts, lead salts, gold salts, platinum salts, palladium salts, iridium salts and rhodium salts in order to improve the storability, processability, pressure resistance, antifungal and antimicrobial properties, antistatic properties and coatability.

TABLE 6

| Emulsion | Average AgI content (%) | Coefficient of variation of AgI content of grains (%) | Average grain diameter (diameter of corresponding spheres (μm) |
|---|---|---|---|
| A | 1.7 | 10 | 0.46 |
| B | 3.5 | 15 | 0.57 |
| C | 8.9 | 25 | 0.66 |
| D | 8.9 | 18 | 0.84 |
| E | 1.7 | 10 | 0.46 |
| F | 3.5 | 15 | 0.57 |
| G | 8.8 | 25 | 0.61 |
| H | 8.8 | 25 | 0.61 |
| I | 8.9 | 18 | 0.84 |
| J | 1.7 | 10 | 0.46 |
| K | 8.8 | 18 | 0.64 |
| L | 14.0 | 25 | 1.28 |
| M | 1.0 | | 0.07 |

| Emulsion | Coefficient of variation of grain diameter (%) | Diameter of projected area (diameter of corresponding circle (μm) | Diameter/thickness ratio |
|---|---|---|---|
| A | 15 | 0.56 | 5.5 |
| B | 20 | 0.78 | 4.0 |
| C | 25 | 0.87 | 5.8 |
| D | 26 | 1.03 | 3.7 |
| E | 15 | 0.56 | 5.5 |
| F | 20 | 0.78 | 4.0 |
| G | 23 | 0.77 | 4.4 |
| H | 23 | 0.77 | 4.4 |
| I | 26 | 1.03 | 3.7 |
| J | 15 | 0.50 | 4.2 |
| K | 23 | 0.85 | 5.2 |
| L | 26 | 1.46 | 3.5 |
| M | 15 | | 1 |

In Table 6:

(1) The emulsions J to L were reduction-sensitized with thiourea dioxide and thiosulfonic acid in the step of preparation of the grains as described in an Example of J. P. KOKAI No. Hei 2-191938.

(2) The emulsions A to I were sensitized by gold sensitization, sulfur sensitization and selenium sensitization methods in the presence of a spectral sensitizing dye mentioned above for each photosensitive layer and sodium thiocyanate as described in an Example of J. P. KOKAI No. Hei 3-237450.

(3) In the preparation of tabular grains, a low-molecular weight gelatin was used as described in an Example of J. P. KOKAI No. Hei 1-158426.

(4) Dislocation lines as described in J. P. KOKAI No. Hei 3-237450 are obserbed on the tabular grains with a high-voltage electron microscope.

(5) The emulsion L had double structure grains each having an internal high-iodine core as described in J. P. KOKAI No. Sho 60-143331.

Preparation of dispersion of organic solid disperse dye:

ExF-2 which will be described below was dispersed as follows: 21.7 ml of water, 3 ml of 5% aqueous solution of sodium p-octylphenoxyethoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the dispersion of the contents was conducted for 2 hours. For the dispersion, a BO type vibration ball mill (a product of Chuo Koki) was ulsed. After the completion of the dispersion, the obtained dispersion was taken out and added to 8 g of 12.5% aqueous gelatin solution. The beads were removed by filtration to obtain a dispersion of the dye in gelatin. The average grain diameter of the fine dye grains was 0.44 μm.

A solid dispersion of each of ExF-3, ExF-4 and ExF-6 was obtained in the same manner as that described above. The average grain diameters of the fine dye grains were 0.24 μm, 0.45 μm and 0.52 μm, respectively ExF-5 was dispersed by a microprecipitation dispersion method described in Example 1 in European Patent Application Kokai (EP) No. 549,489 A. The average grain diameter was 0.06 μm.

ExC-1
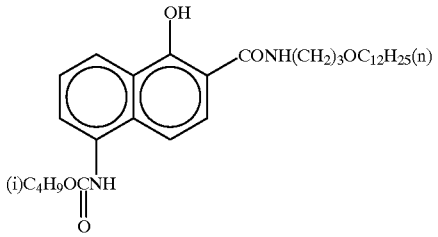
ExC-2
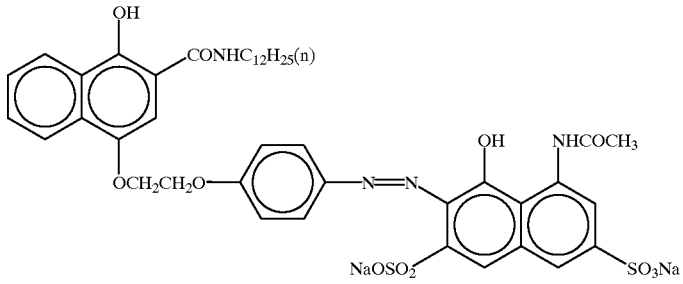
ExC-3
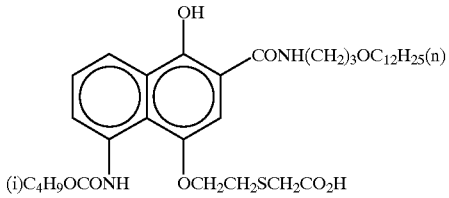
ExC-4
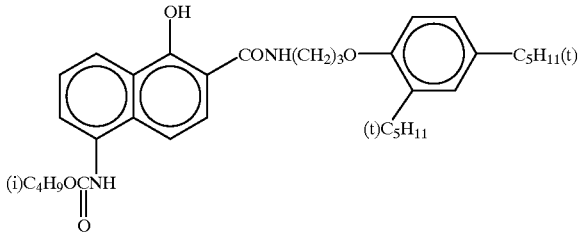
ExC-5
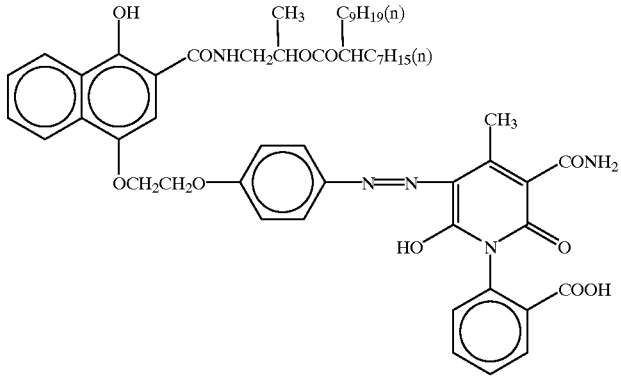

-continued
ExC-6
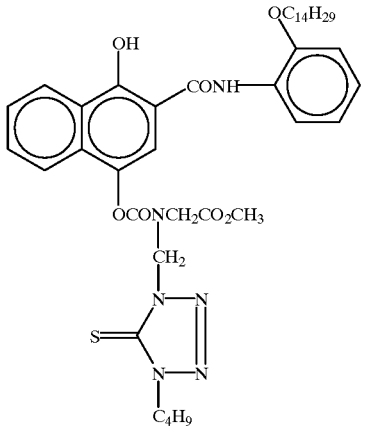
ExC-7
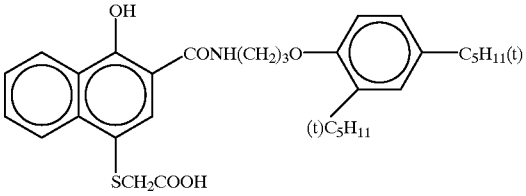
ExC-8
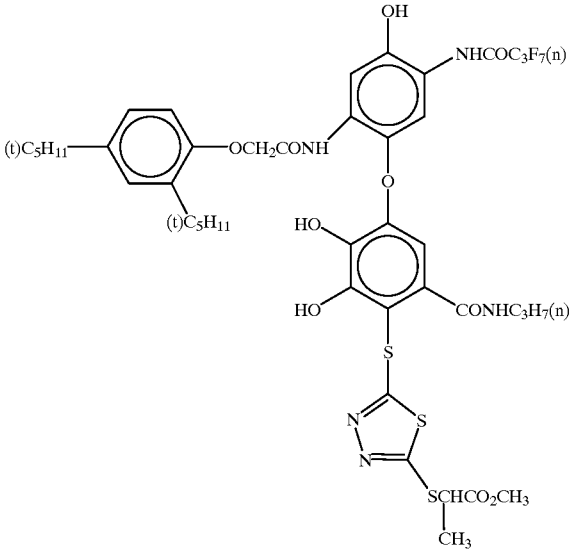
ExM-1
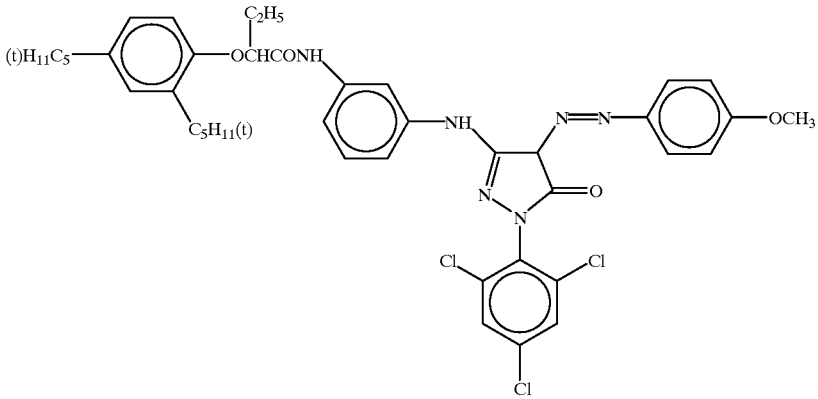

-continued
ExM-2
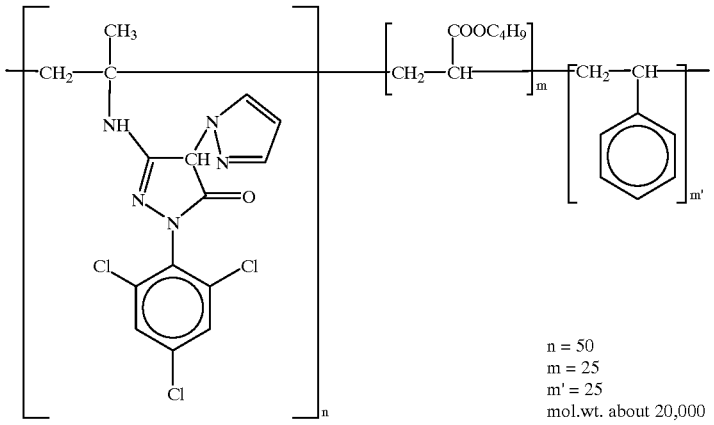
n = 50
m = 25
m' = 25
mol.wt. about 20,000
ExM-3
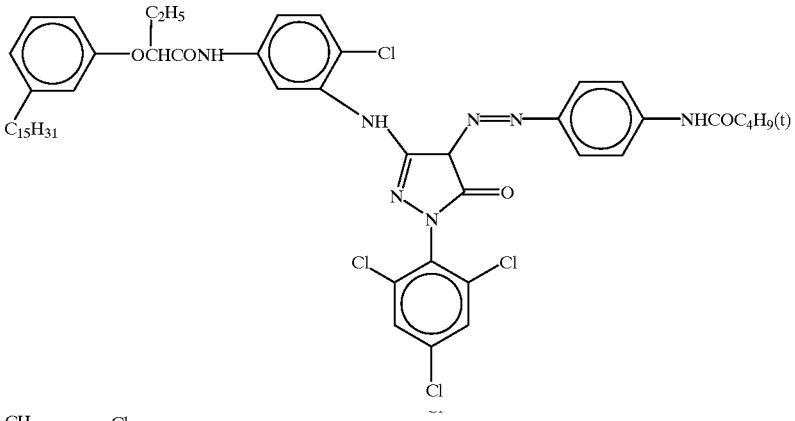
ExM-4
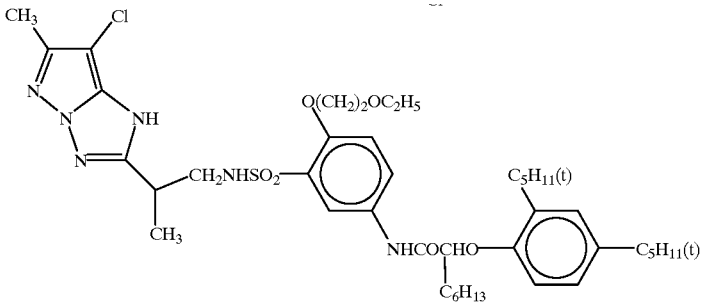
ExM-5
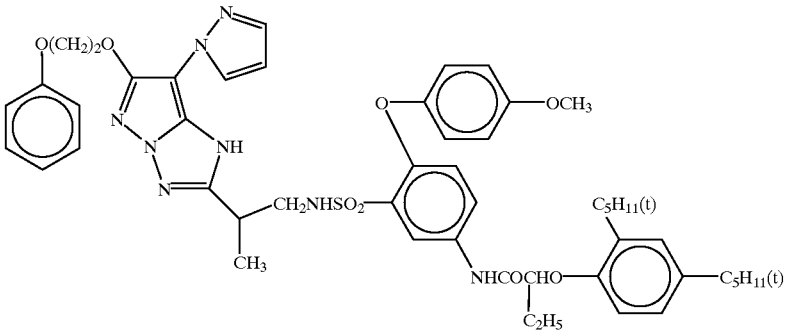

-continued
ExY-1
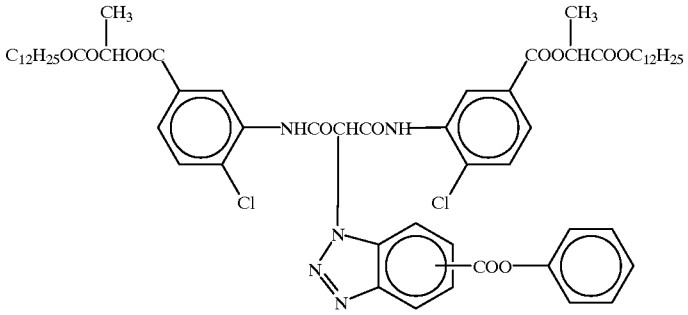
ExY-2
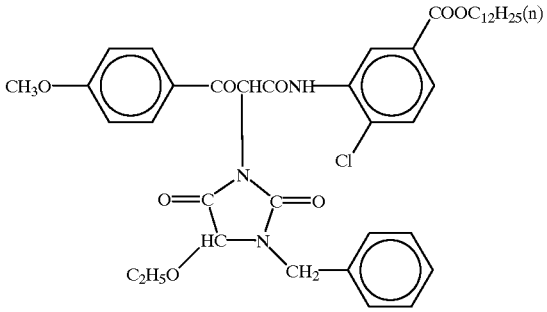
ExY-3
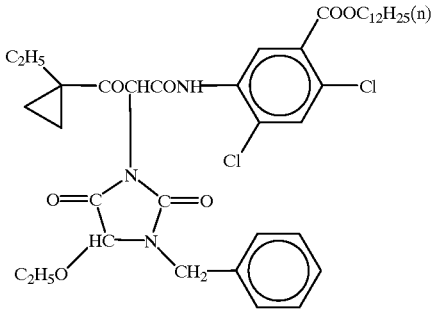
ExY-4
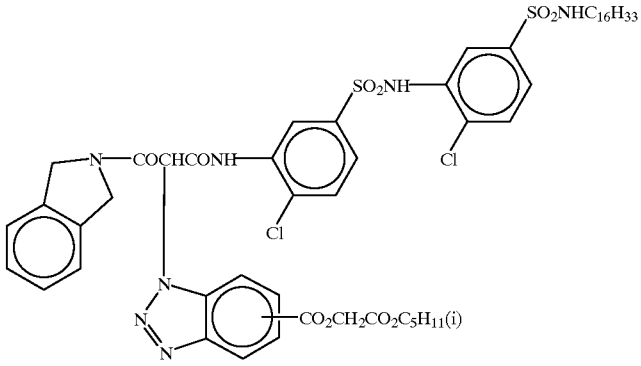

-continued
ExY-5
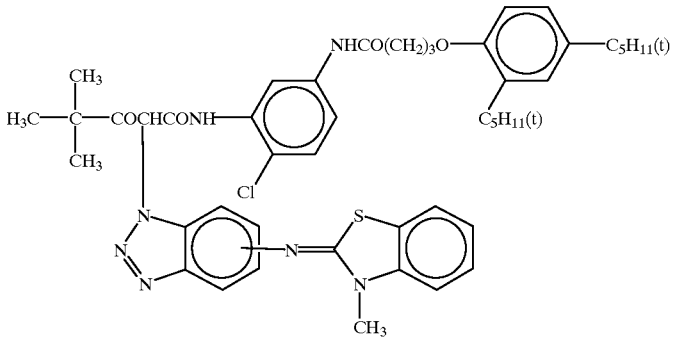
ExF-1
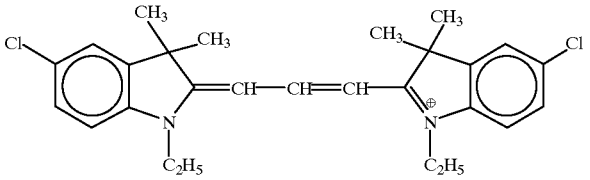
ExF-2
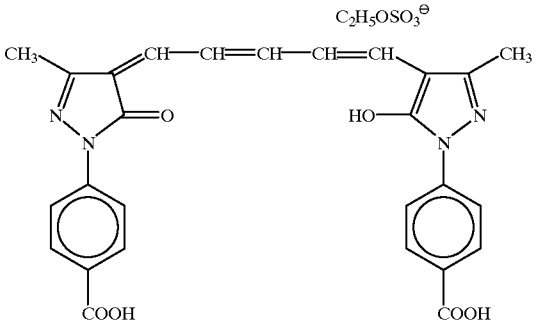
ExF-3
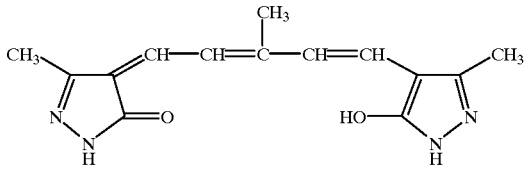
ExF-4
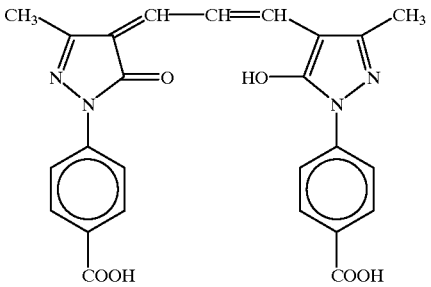
ExF-5
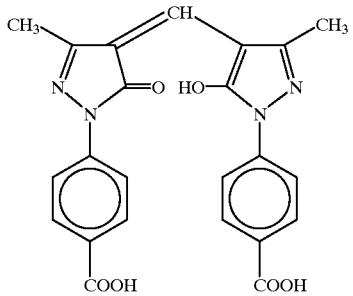

-continued
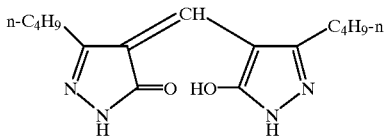
ExF-6
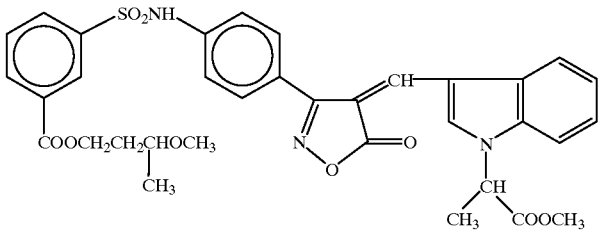
ExF-7
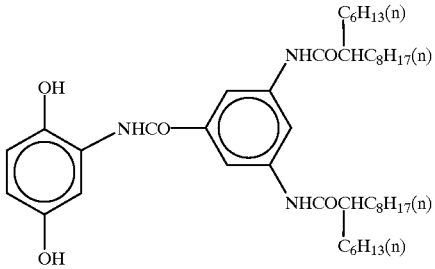
Cpd-1
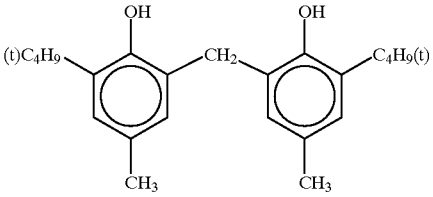
Cpd-2
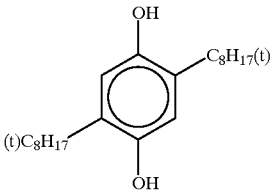
Cpd-3
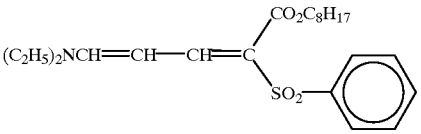
UV-1
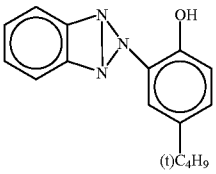
UV-2
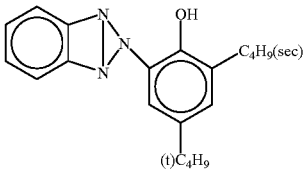
UV-3
Tricresyl phosphate HBS-1
Di-n-butylphthalate HBS-2

-continued
HBS-3
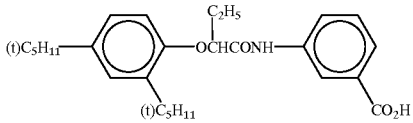
Tri(2-ethylhexyl)phosphate
HBS-4
ExS-1
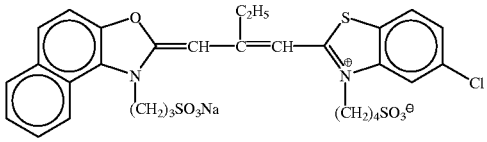
ExS-2
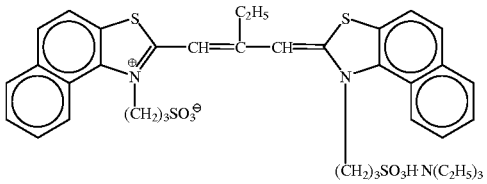
ExS-3
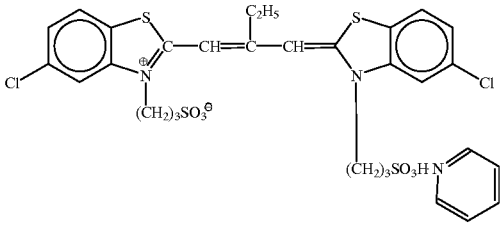
ExS-4
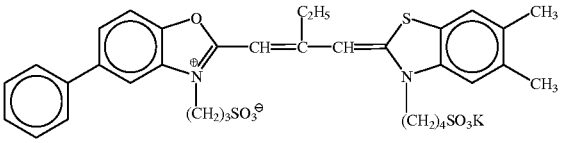
ExS-5
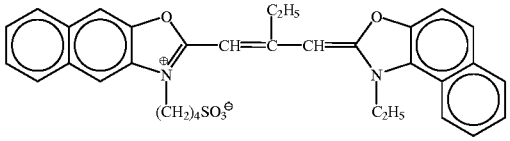
ExS-6
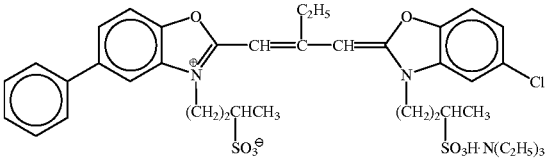
ExS-7
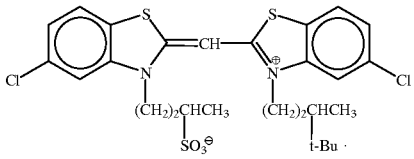
S-1
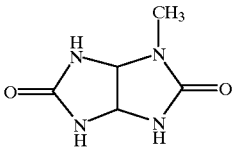

-continued
A mixture of H-1
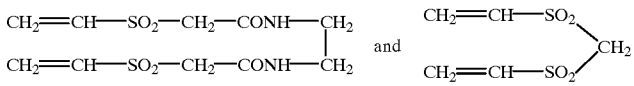
and
(weight ratio = 6/4)
B-1
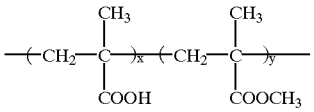
x/y = 10/90
B-2
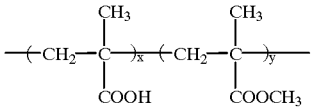
x/y = 40/60
B-3
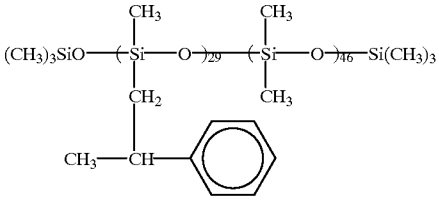
B-4
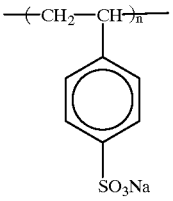
B-5
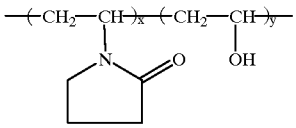
x/y =70/30
B-6
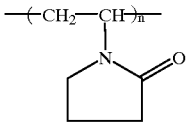
(mol. wt. about 10,000)
W-1
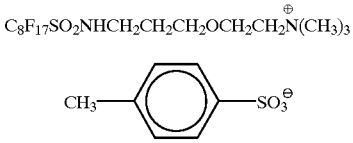
W-2
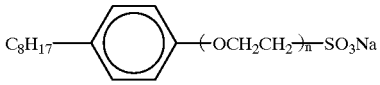
n = 2~4
W-3
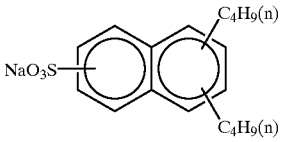
F-1
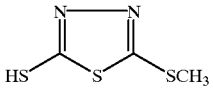

-continued
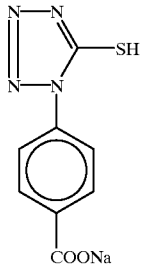
F-2
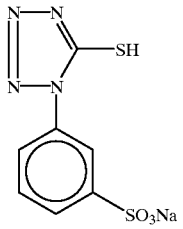
F-3
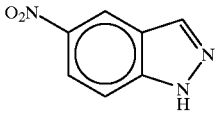
F-4
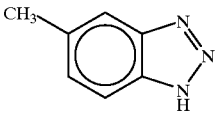
F-5
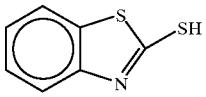
F-6
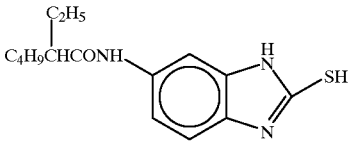
F-7
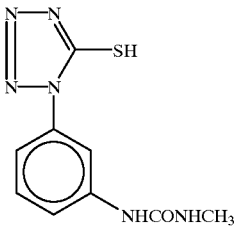
F-8
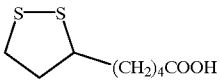
F-9
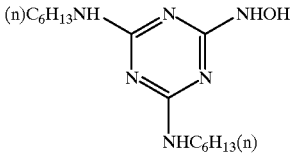
F-10
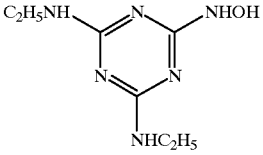
F-11

-continued

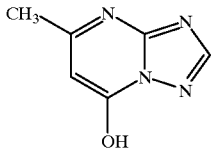

F-12

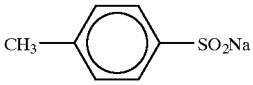

F-13

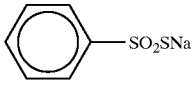

F-14

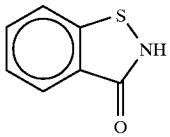

F-15

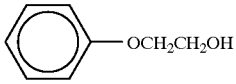

F-16

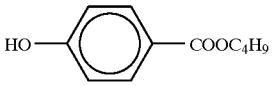

F-17

The thus-prepared photosensitive material was cut into pieces having a width of 24 mm and length of 160 cm. Each piece was perforated to form two holes 2 mm across at an interval of 5.8 mm at one longitudinal end of the photosensitive material and 0.7 mm distant from the transverse edge thereof. The set of two holes was provided repeatedly at intervals of 32 mm. The resulting photosensitive material was fitted in a plastic film-cartridge shown in FIGS. 1 through 7 in U.S. Pat. No. 5,296,887.

FM signals were recorded on the thus-prepared photosensitive material (also referred to as "the sample") at a rate of 100 mm/s between the perforations in the sample with a head capable of input and output (head gap: 5 $\mu$m, turn number: 2,000) from the coated surface side of the magnetic recording layer.

After the completion of the recording of the FM signals, the whole emulsion-surface was uniformly exposed to a light of 1,000 cms and processed by methods described below, after which the photosensitive material was fitted again in the plastic film-cartridge.

Then the film was taken out of the cartridge and the signals were read at the speed same as the speed of recording the signals with the head so as to check whether the correct output was possible or not. The ratio of the error-causing bit number to the input bit number is given in Table 6. An error rate of 0.01% or below is practically permissible, and that of 0.1% or above is impermissible.

The quantity of silver remaining in the photosensitive material after the completion of the process was determined by a method described below. The results are also given in Table 6. Method for determination of the quantity of remaining silver: The quantity of silver remaining in the photosensitive material after 1,000 cms gray exposure was determined by the fluorescent X-ray analysis.

The details of the process were as described below.

After the gray exposure (20 cms) through a wedge at a color temperature of 4800 K, the above-described sample was processed with the following processing solutions in the following processing steps by using a processing machine for motion picture film. The concentrations of the thiosulfate, additives and iodine ion in the bleach-fixing solution were changed as shown in Table 6, and the process was conducted with each of them.

(Processing steps)

| Processing steps | Temp. | Time |
|---|---|---|
| Color development | 40° C. | 90 seconds |
| Bleach-fixing | 40° C. | 40 seconds |
| Stabilization (1) | 40° C. | 15 seconds |
| Stabilization (2) | 40° C. | 15 seconds |
| Stabilization (3) | 40° C. | 15 seconds |
| Drying | 75° C. | 30 seconds |

[The stabilization was conducted by counter-current method from (3) to (1) with three tanks.]

The compositions of the processing solutions were as follows:

| | (unit: g) Mother solution |
|---|---|
| (Color developer) | |
| Diethylenetriaminepentaacetic acid | 4.0 |
| Disodium 4,5-dihydroxybenzene-1,3-disulfonate | 0.5 |
| Sodium sulfite | 4.0 |
| Potassium carbonate | 38.0 |
| Potassium bromide | 4.0 |
| Potassium iodide | 1.3 mg |
| Hydroxylamine sulfate | 4.8 |
| 2-Methyl-4-[N-ethyl-N-(β-hydroxyethyl)amino]aniline sulfate | 13.5 |

-continued

| | |
|---|---|
| Water ad | 1.0 l |
| pH (adjusted with potassium hydroxide and sulfuric acid) | 10.05 |
| (Bleach-fixing solution) | |
| Ethylenediamine-(2-carboxyphenyl)-N,N',N'-triacetic acid | 0.10 mol |
| Ethylenediaminetetraacetic acid | 0.08 mol |
| Ferric chloride | 0.16 mol |
| Aqueous ammonium thiosulfate solution (700 g/l) (ATS) | see Table 6 |
| Ammonium iodide | see Table 6 |
| Ammonium sulfite | 15.0 |
| Succinic acid | 12.0 |
| Additive (compound of formula I) | 0.15 mol |
| Water | 1.0 l |
| pH (adjusted with nitric acid and ammonia water) | 5.0 |

(The recipe of the mother solution was the same as that of the replenisher)

| (Stabilizer) | (unit: g) |
|---|---|
| Sodium p-toluenesulfinate | 0.03 |
| Polyoxyethylene-p-monononyl phenyl ether (average degree of polymerization: 10) | 0.2 |
| Sodium chlornated isocyanurate | 0.02 |
| Deionized water (electric conductivity: 5 μs/cm or below) | 1000 ml |
| pH | 6.5 |

The process was conducted with each of the bleach-fixing solutions having varied compositions.

The results of the quantitative determination of remaining silver and the examination of the accuracy in reading are given in Table 7.

TABLE 7

| | Fixing agent | | | | |
|---|---|---|---|---|---|
| No. | ATS (mol/l) | General formula (I) (mol/l) | | Ratio | Ammonium iodide (mol/l) |
| 01 | 1.5 | 0 | | 0 | 0.002 |
| 02 | 1.5 | 0 | | 0 | 0.01 |
| 03 | 1.5 | 0 | | 0 | 0.04 |
| 04 | — | I-4 | 1.5 | 100 | 0.01 |
| 05 | — | I-12 | 1.5 | 100 | 0.01 |
| 06 | 1.4 | I-4 | 0.1 | 0.071 | 0.01 |
| 07 | 1.3 | I-4 | 0.2 | 0.153 | 0.01 |
| 08 | 1.2 | I-4 | 0.3 | 0.250 | 0.01 |
| 09 | 1.0 | I-4 | 0.5 | 0.500 | 0.01 |
| 10 | 1.25 | I-17 | 0.25 | 0.20 | 0.002 |
| 11 | 1.25 | I-17 | 0.25 | 0.20 | 0.004 |
| 12 | 1.25 | I-17 | 0.25 | 0.20 | 0.01 |
| 13 | 1.25 | I-17 | 0.25 | 0.20 | 0.04 |
| 14 | 1.25 | I-18 | 0.25 | 0.20 | 0.002 |
| 15 | 1.25 | I-18 | 0.25 | 0.20 | 0.004 |
| 16 | 1.25 | I-18 | 0.25 | 0.20 | 0.01 |
| 17 | 1.25 | I-18 | 0.25 | 0.20 | 0.04 |
| 18 | 1.25 | I-41 | 0.25 | 0.20 | 0.002 |
| 19 | 1.25 | I-41 | 0.25 | 0.20 | 0.004 |
| 20 | 1.25 | I-41 | 0.25 | 0.20 | 0.01 |
| 21 | 1.25 | I-41 | 0.25 | 0.20 | 0.04 |
| 22 | 1.25 | I-43 | 0.25 | 0.20 | 0.002 |
| 23 | 1.25 | I-43 | 0.25 | 0.20 | 0.004 |
| 24 | 1.25 | I-43 | 0.25 | 0.20 | 0.01 |
| 25 | 1.25 | I-43 | 0.25 | 0.20 | 0.04 |
| 26 | 1.4 | I-12 | 0.1 | 0.071 | 0.01 |
| 27 | 1.3 | I-12 | 0.2 | 0.153 | 0.01 |
| 28 | 1.2 | I-12 | 0.3 | 0.250 | 0.01 |
| 29 | 1.0 | I-12 | 0.5 | 0.500 | 0.01 |

TABLE 7-continued

| | Sample 101 | | Sample 102 | | Sample 103 | | |
|---|---|---|---|---|---|---|---|
| No. | Quantity of silver* | Error rate (%) | Quantity of silver* | Error rate (%) | Quantity of silver* | Error rate (%) | Remarks |
| 01 | 22 | 0.23 | 23 | 0.23 | 23 | 0.23 | Comp. Ex. |
| 02 | 26 | 0.36 | 25 | 0.36 | 25 | 0.33 | Comp. Ex. |
| 03 | 36 | 0.48 | 34 | 0.49 | 37 | 0.46 | Comp. Ex. |
| 04 | 6.5 | 0.008 | 6.5 | 0.010 | 7.0 | 0.009 | Present invention |
| 05 | 4.0 | 0.007 | 4.1 | 0.009 | 4.0 | 0.009 | Present invention |
| 06 | 1.1 | 0.001 | 1.1 | 0.004 | 1.1 | 0.003 | Present invention |
| 07 | 0.5 | 0.001 | 0.5 | 0.004 | 0.5 | 0.003 | Present invention |
| 08 | 0.5 | 0.001 | 0.5 | 0.004 | 0.5 | 0.003 | Present invention |
| 09 | 3.1 | 0.006 | 3.1 | 0.008 | 3.1 | 0.008 | Present invention |
| 10 | 3.9 | 0.006 | 4.2 | 0.010 | 4.2 | 0.009 | Present invention |
| 11 | 0.4 | 0.002 | 0.4 | 0.004 | 0.4 | 0.003 | Present invention |
| 12 | 0.4 | 0.002 | 0.5 | 0.004 | 0.5 | 0.003 | Present invention |
| 13 | 6.5 | 0.007 | 7.1 | 0.010 | 6.9 | 0.009 | Present invention |
| 14 | 3.3 | 0.007 | 4.1 | 0.010 | 4.0 | 0.009 | Present invention |
| 15 | 0.4 | 0.001 | 0.4 | 0.004 | 0.5 | 0.003 | Present invention |
| 16 | 0.5 | 0.001 | 0.5 | 0.005 | 0.5 | 0.003 | Present invention |
| 17 | 6.5 | 0.005 | 7.0 | 0.009 | 6.9 | 0.008 | Present invention |
| 18 | 3.3 | 0.005 | 4.4 | 0.009 | 4.2 | 0.009 | Present invention |
| 19 | 0.5 | 0.001 | 0.5 | 0.004 | 0.5 | 0.004 | Present invention |
| 20 | 0.5 | 0.001 | 0.6 | 0.005 | 0.5 | 0.003 | Present invention |
| 21 | 6.0 | 0.006 | 7.0 | 0.010 | 6.5 | 0.009 | Present invention |
| 22 | 3.5 | 0.008 | 6.1 | 0.010 | 6.0 | 0.010 | Present invention |
| 23 | 2.5 | 0.004 | 2.6 | 0.008 | 2.7 | 0.008 | Present invention |
| 24 | 2.6 | 0.004 | 2.8 | 0.009 | 2.8 | 0.008 | Present invention |
| 25 | 6.0 | 0.006 | 6.5 | 0.010 | 6.8 | 0.010 | Present invention |
| 26 | 1.0 | 0.001 | 1.4 | 0.004 | 1.2 | 0.004 | Present invention |
| 27 | 0.4 | 0.001 | 0.6 | 0.004 | 0.5 | 0.003 | Present invention |
| 28 | 0.5 | 0.001 | 0.7 | 0.004 | 0.5 | 0.003 | Present invention |
| 29 | 3.3 | 0.006 | 3.5 | 0.009 | 3.5 | 0.008 | Present invention |

*Quantity of remaining silver: $\mu g/cm^2$.

It is apparent from the results given in Table 7 that in the present invention, excellent desilverization is attained and the accuracy in reading the magnetic recording is improved, though the desilverization time is short. Particularly, the sample 101 in which the support is a heat-treated polyethylene naphthalate gave excellent results.

Further, Nos. 6, 7, 8, 26, 27 and 28 wherein the compound of the formula (I) was used in combination with ammonium thiosulfate in a ratio of 0.05 to 0.30 exhibited excellent effects Nos. 6, 7, 8, 11, 12, 15, 16, 19, 20, 26, 27 and 28 having an iodine ion concentration of 0.003 to 0.03 mol/l exhibited the most preferred results.

EXAMPLE 2

Samples 201 to 205 were prepared by using the same support as that of Sample 101 in Example 1 and varying the amount of coated silver in the layers as follows:

| Sample | 201 | 202 | 203 | 204 | 205 |
|---|---|---|---|---|---|
| The first layer | | | | | |
| Colloidal silver | 0.09 | 0.09 | 0.09 | 0.19 | 0.19 |
| The second layer | | | | | |
| Emulsion M | 0.065 | 0.065 | 0.065 | 0.165 | 0.165 |
| The third layer | | | | | |
| Emulsion A | 0.25 | 0.15 | 0.35 | 0.35 | 0.45 |
| Emulsion B | 0.25 | 0.15 | 0.35 | 0.35 | 0.45 |
| The fourth layer | | | | | |
| Emulsion C | 0.70 | 0.60 | 0.80 | 0.70 | 0.90 |
| The fifth layer | | | | | |
| Emulsion D | 1.40 | 1.20 | 1.40 | 1.60 | 1.60 |
| The seventh layer | | | | | |
| Emulsion E | 0.15 | 0.15 | 0.25 | 0.15 | 0.25 |
| Emulsion F | 0.10 | 0.10 | 0.10 | 0.20 | 0.20 |
| Emulsion G | 0.10 | 0.10 | 0.10 | 0.20 | 0.20 |
| The eighth layer | | | | | |
| Emulsion H | 0.80 | 0.70 | 0.90 | 0.90 | 1.00 |
| The ninth layer | | | | | |
| Emulsion I | 1.25 | 1.15 | 1.35 | 1.45 | 1.45 |
| The tenth layer | | | | | |
| Colloidal silver | 0.015 | 0.015 | 0.015 | 0.015 | 0.015 |
| The eleventh layer | | | | | |
| Emulsion J | 0.09 | 0.09 | 0.09 | 0.19 | 0.19 |
| Emulsion K | 0.09 | 0.09 | 0.09 | 0.19 | 0.19 |
| The twelfth layer | | | | | |
| Emulsion L | 1.00 | 0.90 | 1.20 | 1.20 | 1.30 |
| The fourteenth layer | | | | | |
| Emulsion M | 0.10 | 0.10 | 0.20 | 0.20 | 0.30 |
| Total (g/m$^2$) | 6.45 | 5.65 | 7.35 | 8.15 | 8.85 |

The thus-prepared photosensitive material was cut into pieces having a width of 24 mm and length of 160 cm. Each piece was perforated to form two holes 2 mm across at an interval of 5.8 mm at one longitudinal end of the photosensitive material and 0.7 mm distant from the transverse edge thereof. The set of two holes was provided repeatedly at intervals of 32 mm. The resulting photosensitive material was fitted in a plastic film-cartridge shown in FIGS. 1 through 7 in U.S. Pat. No. 5,296,887.

FM signals were recorded on the thus-prepared sample at a rate of 100 mm/s between the perforations in the photosensitive material with a head capable of input and output (head gap: 5 $\mu$m, turn number: 2,000) from the coated surface side of the magnetic recording layer.

After the completion of the recording of the FM signals, the whole emulsion surface was uniformly exposed to a light of 1,000 cms and processed by methods described below, after which the photosensitive material was fitted again in the plastic film-cartridge.

Then the film was taken out and the signals were read at the speed same as the speed of recording the signals with the head so as to check whether the correct output was possible or not. The ratio of the error-causing bit number to the input bit number is given in Table 8. An error rate of 0.01% or below is practically permissible, and that of 0.1% or above is impermissible.

The details of the process which was actually conducted will be described below.

The Sample 201 prepared as described above was processed, after the image-wise exposure, in the following steps with the following processing solutions by means of a processing machine for motion picture film. The recipe of the bleach-fixing solution was varied as described below, and the continuous process was conducted with each of them.

| (Processing steps) | | | |
|---|---|---|---|
| Processing step | Temp. | Time | Amount of replenisher* |
| Color development | 45° C. | 50 sec | 10 |
| Bleach-fixing | 45° C. | 50 sec | 15 |
| Washing with water (1) | 45° C. | 10 sec | — |
| Washing with water (2) | 45° C. | 10 sec | — |
| Washing with water (3) | 45° C. | 10 sec | 15 |
| Drying | 75° C. | 20 sec | — |

[The washing was conducted by counter-current method from tank (3) to tank (1) by using the three tanks.]
*per a piece having a size of 24 mm × 160 cm.

The compositions of the processing solutions were as follows:

| | (unit: g) | |
|---|---|---|
| | mother liquor | Replenisher |
| (Color developer) | | |
| Diethylenetriaminepentaacetic acid | 4.0 | 4.0 |
| Disodium 4,5-dihydroxybenzene-1,3-disulfonate | 0.5 | 0.5 |
| Sodium sulfite | 4.0 | 8.0 |
| Potassium carbonate | 38.0 | 38.0 |
| Potassium bromide | 2.0 | — |
| Potassium iodide | 1.0 mg | — |
| N,N-(Disulfonatoethyl)hydroxylamine | 10.0 | 18.0 |
| 2-Methyl-4-[N-ethyl-N-(β-hydroxyethyl)-amino]aniline sulfate | 12.0 | 20.0 |
| Water ad | 1.0 l | 1.0 l |
| pH (adjusted with potassium hydroxide and sulfuric acid) | 10.05 | 10.45 |
| (Bleach-fixing solution) | | |
| Ethylenediamine-(2-carboxyphenyl)-N,N',N'-triacetic acid | 0.20 mol | 0.25 mol |
| Ferric chloride | 0.20 mol | 0.30 mol |
| Aqueous ammonium thiosulfate (700 g/l) | 1.50 mol | 2.00 mol |
| Ammonium iodide | 1.0 | — |
| Ammonium sulfite | 20.0 | 45.0 |
| Compound of formula (I) | 0.20 mol | 0.25 mol |
| Compound of formula (II) | 0.15 mol | 0.25 mol |
| Water ad | 1.0 l | 1.0 l |
| pH (adjusted with nitric acid and ammonia water) | 6.5 | 6.0 |

The recipe of the mother liquor was the same as that of the replenisher

| (Stabilizer) | (unit: g) |
|---|---|
| Sodium p-toluenesulfinate | 0.03 |
| Polyoxyethylene-p-monononyl phenyl ether (average degree of polymerization: 10) | 0.2 |
| Sodium chlorinated isocyanurate | 0.02 |
| Water ad | 1000 ml |
| pH (adjusted with NaOH and sulfuric acid) | 6.5 |

The running process was conducted with each of the combinations of the color developer with the bleach-fixing solution given in Table 8.

After the completion of the running, the Samples 201 to 205 were processed in the same manner as in Example 1 to determine the quantity of remaining silver and accuracy in reading the magnetic records. The results are given in Table 8.

TABLE 8

| | Bleach-fixing solution | | Sample 201 | | Sample 202 | |
|---|---|---|---|---|---|---|
| No | General formula (I) (mol/l) | General formula (II) (mol/l) | Quantity of silver* | Error rate (%) | Quantity of silver* | Error rate (%) |
| 51 | — | — | 34 | 0.33 | 34 | 0.33 |
| 52 | I-4 | — | 1.0 | 0.007 | 0.9 | 0.005 |
| 53 | I-12 | — | 1.1 | 0.007 | 1.2 | 0.005 |
| 54 | I-14 | — | 1.3 | 0.007 | 1.3 | 0.005 |
| 55 | I-28 | — | 1.2 | 0.007 | 1.2 | 0.006 |
| 56 | I-31 | — | 1.4 | 0.008 | 1.3 | 0.005 |
| 57 | I-41 | — | 1.5 | 0.008 | 1.3 | 0.006 |
| 58 | I-4 | II-4 | 1.0 | 0.003 | 0.9 | 0.001 |
| 59 | I-12 | II-4 | 1.1 | 0.003 | 1.2 | 0.001 |
| 60 | I-14 | II-4 | 1.3 | 0.003 | 1.4 | 0.001 |
| 61 | I-28 | II-4 | 1.2 | 0.003 | 1.2 | 0.001 |
| 62 | I-31 | II-4 | 1.4 | 0.004 | 1.5 | 0.002 |
| 63 | I-41 | II-4 | 1.5 | 0.004 | 1.4 | 0.002 |
| 64 | I-4 | II-2 | 1.6 | 0.003 | 1.5 | 0.001 |
| 65 | I-4 | II-3 | 1.8 | 0.003 | 1.5 | 0.001 |
| 66 | I-4 | II-7 | 1.3 | 0.003 | 1.1 | 0.001 |
| 67 | I-4 | II-9 | 1.2 | 0.003 | 1.0 | 0.001 |

| | Sample 203 | | Sample 204 | | Sample 205 | |
|---|---|---|---|---|---|---|
| No | Quantity of silver* | Error rate (%) | Quantity of silver* | Error rate (%) | Quantity of silver* | Error rate (%) |
| 51 | 35 | 0.33 | 35 | 0.33 | 34 | 0.33 |
| 52 | 1.5 | 0.008 | 3.8 | 0.010 | 4.0 | 0.010 |
| 53 | 1.6 | 0.008 | 3.9 | 0.010 | 4.1 | 0.010 |
| 54 | 1.7 | 0.008 | 3.9 | 0.010 | 4.2 | 0.010 |
| 55 | 1.6 | 0.008 | 3.9 | 0.010 | 4.1 | 0.010 |
| 56 | 2.0 | 0.009 | 4.2 | 0.010 | 4.6 | 0.010 |
| 57 | 2.0 | 0.009 | 4.4 | 0.010 | 4.5 | 0.010 |
| 58 | 1.6 | 0.005 | 3.6 | 0.007 | 4.3 | 0.009 |
| 59 | 1.6 | 0.005 | 3.7 | 0.008 | 4.4 | 0.009 |
| 60 | 1.7 | 0.005 | 3.5 | 0.008 | 4.4 | 0.009 |
| 61 | 1.6 | 0.005 | 3.4 | 0.008 | 4.3 | 0.009 |
| 62 | 1.7 | 0.006 | 3.2 | 0.010 | 4.4 | 0.010 |
| 63 | 1.5 | 0.006 | 3.0 | 0.010 | 4.2 | 0.010 |
| 64 | 1.9 | 0.005 | 3.1 | 0.007 | 4.3 | 0.010 |
| 65 | 1.9 | 0.005 | 3.2 | 0.009 | 4.3 | 0.010 |
| 66 | 1.7 | 0.005 | 3.7 | 0.009 | 4.8 | 0.010 |
| 67 | 1.6 | 0.005 | 3.7 | 0.009 | 4.8 | 0.010 |

Remarks: No. 51 is a Comparative Example, and Nos. 52 to 67 are Examples of the present invention.
*Quantity of remaining silver: $\mu g/cm^2$.

It is apparent from the results given in Table 8 that when a compound of the formula (I) is used, the desilvering effect and the accuracy in reading the magnetic record are improved and that particularly when a compound of the formula (II) is used in combination therewith, the improvement in the accuracy in reading is remarkable.

The remarkable effects were obtained in the Samples 201, 202 and 203 containing 8 $g/m^2$ or less of coated silver, and the most excellent results were obtained in the Sample 202 containing 6 $g/m^2$ or less of coated silver.

What is claimed is:

1. A method for processing a silver halide color photographic photosensitive material which comprises the steps of desilverizing a photosensitive silver halide material having at least one red-sensitive layer, green-sensitive layer and blue-sensitive layer respectively on one side of a transparent support and a magnetic recording layer containing magnetic grains on the other side after the color development and then washing it with water and/or stabilizing it, wherein a bath having fixing function used in the desilverization step contains a compound of the following formula (I):

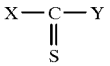

(I)

wherein X and Y each represent an alkyl group, alkenyl group, aralkyl group, aryl group, heterocyclic group, $—N(R^1)R^2$, $—N(R^3)N(R^4)R^5$, $—OR^6$ or $—SR^7$, or X and Y may together form a ring, with the proviso that at least one of X and Y is substituted with at least one of carboxylic acids or salts thereof, sulfonic acids or salts thereof, phosphonic acids or salts thereof, amino groups, ammonium groups and hydroxyl group, $R^1$, $R^2$, $R^3$, $R^4$ and $R^5$ each represent a hydrogen atom, alkyl group, alkenyl group, aralkyl group, aryl group or heterocyclic group, and $R^6$ and $R^7$ each represent a hydrogen atom, cation, alkyl group, alkenyl group, aralkyl group, aryl group or heterocyclic group.

2. The method of claim 1, wherein X and Y each represent an alkyl group having 1 to 10 carbon atoms, alkenyl group having 2 to 10 carbon atoms, aralkyl group having 7 to 12 carbon atoms, aryl group having 6 to 12 carbon atoms, 5-membered or 6-membered heterocyclic ring, $—N(R^1)R^2$, $—N(R^3)N(R^4)R^5$, $—OR^6$ or $—SR^7$, or X and Y may together form a ring selected from the group consisting of imidazoline-2-thion ring, imidazolidine-2-thion ring, thiazoline-2-thion ring, thiazolidine-2-thion ring, oxazoline-2-thion ring, oxazolidine-2-thion ring and pyrrolidine-2-thion ring and benzo-condensed rings thereof, with the proviso that at least one of X and Y is substituted with at least one of carboxylic acids or salts thereof, sulfonic acids or salts thereof, phosphonic acids or salts thereof, amino groups, ammonium groups and hydroxyl group, $R^1$, $R^2$, $R^3$, $R^4$ and $R^5$ each represent a hydrogen atom, alkyl group having 1 to 10 carbon atoms, alkenyl group having 2 to 10 carbon atoms, aralkyl group having 7 to 12 carbon atoms, aryl group having 6 to 12 carbon atoms, 5-membered or 6-membered heterocyclic ring, and $R^6$ and $R^7$ each represent a hydrogen atom, cation, alkyl group having 1 to 10 carbon atoms, alkenyl group having 2 to 10 carbon atoms, aralkyl group having 7 to 12 carbon atoms, aryl group having 6 to 12 carbon atoms, 5-membered or 6-membered heterocyclic ring.

3. The method of claim 1, wherein the compound of the formula (I) is a compound of the following formula (I-II):

(I-II)

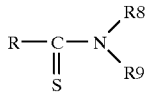

wherein R represents an alkyl group having 1 to 10 carbon atoms, $—N(R^{10})R^{11}$ group having 0 to 10 carbon atoms or $—N(R^{12})N(R^{13})R^{14}$ group having 0 to 10 carbon atoms; and $R^8$, $R^9$, $R^{10}$, $R^{11}$, $R^{12}$, $R^{13}$ and R14 each represent a hydrogen atom or alkyl group having 1 to 10 carbon atoms, with the proviso that at least one of $R^8$, $R^9$, $R^{10}$, $R^{11}$, $R^{12}$, $R^{13}$ and $R^{14}$ represents an alkyl group substituted with a group selected from among carboxylic acids or salts thereof, sulfonic acids or salts thereof, phosphonic acids or salts thereof, amino groups, ammonium groups and hydroxyl group.

4. The method of claim 3, wherein R represents —N($R^{10}$)$R^{11}$ having 0 to 6 carbon atoms or —N($R^{12}$)N($R^{13}$)$R^{14}$ having 0 to 6 carbon atoms. $R^8$, $R^9$, $R^{10}$, $R^{11}$, $R^{12}$, $R^{13}$ and $R^{14}$ each represent a hydrogen atom or alkyl group having 1 to 10 carbon atoms, with the proviso that at least one of $R^8$, $R^9$, $R^{10}$, $R^{11}$, $R^{12}$, $R^{13}$ and $R^{14}$ represents an alkyl group substituted with a group selected from among carboxylic acids, salts thereof, sulfonic acids and salts thereof.

5. The method of claim 3, wherein the compound of the formula (I-II) is a compound of the following formula (I-III):

(I-III)

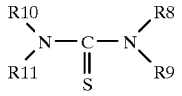

wherein $R^8$, $R^9$, $R^{10}$ and $R^{11}$ each represent a hydrogen atom or alkyl group having 1 to 10 carbon atoms, with the proviso that at least one of $R^8$, $R^9$, $R^{10}$ and $R^{11}$ represents an alkyl group substituted with a group selected from among sulfonic acids, salts thereof, carboxylic acids and salts thereof.

6. The method of claim 5, wherein the compound of the formula (I-III) is a compound of the following formula (I-IV):

(I-IV)

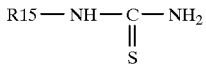

wherein $R^{15}$ represents an alkyl group having 1 to 10 carbon atoms substituted with at least one sulfonic acid, a salt thereof, a carboxylic acid, a salt thereof.

7. The method of claim 6, wherein $R^{15}$ represents an alkyl group having 1 to 10 carbon atoms substituted with one sulfonic acid or salt thereof.

8. The method of claim 3, wherein the bath having fixing function contains the compound in an amount of 0.03 to 3 moles per liter and 0.003 to 0.03 mol/l of iodine ion.

9. The method of claim 3, wherein the bath having fixing function contains the compound in an amount of 0.03 to 3 moles per liter, 0.003 to 0.03 mol/l of iodine ion and thiosulfuric acid residue, a molar ratio of the compound to thiosulfuric acid residue being 1:0.05 to 1:0.30.

10. The method of claim 3, wherein the bath having fixing function contains the compound in an amount of 0.03 to 3 moles per liter and a compound of the formula (II) in an amount of 0.01 to 2 moles per liter (II)

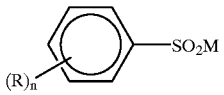

wherein R represents a substituent of the benzene ring, n represents an integer of 0 to 6, and when n is 2 or larger, R's may be the same or different from each other, and M represents a hydrogen atom, alkali metal alkaline earth metal, ammonium or amine.

11. The method of claim 3, wherein the silver halide color photographic photosensitive material has a silver content of 2 to 8 g/$m^2$.

12. The method of claim 1, wherein the bath having fixing function comprises a bleach-fixing solution, and wherein the compound of formula (I) is a compound of the following formula (I-III), and the solution further contains a compound of formula (II):

(I-III)

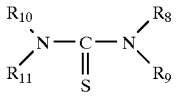

wherein $R^8$, $R^9$, $R^{10}$ and $R^{11}$ each represent a hydrogen atom or alkyl group having 1 to 10 carbon atoms, with the proviso that at least one of $R^8$, $R^9$, $R^{10}$ and $R^{11}$ represents an alkyl group substituted with a group selected from among sulfonic acids, salts thereof, carboxylic acids and salts thereof (II)

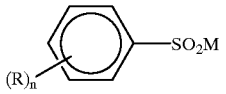

wherein R represents a substituent of the benzene ring, n represents an integer of 0 to 6, and when n is 2 or larger, R's may be the same or different from each other, and M represents a hydrogen atom, alkali metal, alkaline earth metal, ammonium or amine.

13. The method of claim 12, wherein R represents an alkyl groups having 1 to 3 carbon atoms, substituted alkyl groups having 1 to 3 carbon atoms, alkoxy groups having 1 to 3 carbon atoms, hydroxyl group, nitro group, carboxylic acid groups, sulfonic acid groups, halogen atoms and phosphonic acid groups.

14. The method of claim 12, wherein the bleach-fixing solution contains the compound of the formula (I-III) in an amount of 0.03 to 3 moles per liter and the compound of the formula (II) in an amount of 0.01 to 2 moles per liter.

15. The method of claim 14, wherein the compound of the formula (I-III) is a compound of the following formula (I-IV):

(I-IV)

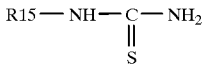

wherein $R^{15}$ represents an alkyl group having 1 to 10 carbon atoms substituted with at least one sulfonic acid, a salt thereof, a carboxylic acid, a salt thereof.

16. The method of claim 15, wherein $R^{15}$ represents an alkyl group having 1 to 10 carbon atoms substituted with one sulfonic acid or salt thereof.

17. The method of claim 12, wherein the bleach-fixing solution contains 0.003 to 0.03 mol/l of iodine ion.

18. The method of claim 12, wherein the bleach-fixing solution contains thiosulfuric acid residue, a molar ratio of the compound to thiosulfuric acid residue being 1:0.05 to 1:0.30.

19. The method of claim 12, wherein the silver halide color photographic photosensitive material has a silver content of 2 to 8 g/$m^2$.

20. The method of claim 12, wherein the bleach-fixing solution is replenished in an amount of 100 to 550 ml/$m^2$.

* * * * *